US006388646B1

(12) United States Patent
Fujiwara et al.

(10) Patent No.: US 6,388,646 B1
(45) Date of Patent: May 14, 2002

(54) DISPLAY DEVICE

(75) Inventors: Koji Fujiwara, Tenri; Tomohiko Yamamoto, Nara; Keiichi Tanaka, Tenri; Naoto Inoue; Hideki Ichioka, both of Nara, all of (JP)

(73) Assignee: Shapr Kabushiki Kaisha, Osaka (JP)

( * ) Notice: Subject to any disclaimer, the term of this patent is extended or adjusted under 35 U.S.C. 154(b) by 0 days.

(21) Appl. No.: 09/494,140

(22) Filed: Jan. 28, 2000

(30) Foreign Application Priority Data

Jan. 29, 1999 (JP) ..... 11-022737

(51) Int. Cl.[7] ..... G09G 3/36

(52) U.S. Cl. ..... 345/87; 345/89; 345/84; 345/94; 345/100; 345/98; 345/99; 345/95; 345/211; 345/213; 345/214

(58) Field of Search ..... 345/87, 98, 100, 345/95, 99, 210, 211, 94, 89, 84, 213, 214

(56) References Cited

U.S. PATENT DOCUMENTS 4,694,287 A 9/1987 Chenevas-Paule et al.
5,113,181 A * 5/1992 Inoue et al. ..... 340/783
6,067,066 A * 5/2000 Kubota et al. ..... 345/98

FOREIGN PATENT DOCUMENTS

JP 4-219735 A 8/1992
JP 5-61019 A 3/1993
JP 7-20495 A 1/1995

* cited by examiner

*Primary Examiner*—Richard Hjerpe
*Assistant Examiner*—Ali Zamani
(74) *Attorney, Agent, or Firm*—Nixon & Vanderhye, P.C.

(57) ABSTRACT

It is an object of the invention to reduce a leakage low-frequency electric field from a panel section of a matrix type. In the case where a panel section has a usual current structure in which the panel section has a single common electrode elongating over the whole of the display region of the panel section, the maximum voltage difference of a reference signal supplied to the common electrode is defined to be $0.3678 \times x^{-0.6136}$ (wherein x is the area of the display region) or less. In the case where the panel section has the so-called counter source structure and a plurality of column electrodes, the maximum voltage difference of a reference signal supplied to the column electrodes is defined to be $ax^{-b}$ (wherein $a=0.3565 \times y^{-0.6829}$, $b=-0.0937y+0.7091$, and y is a ratio of the area of all the column electrodes to the area of the display region) or less. In the case where a panel section has the counter source structure, the average area per unit length of one part of the column electrode opposed to a signal line is smaller than the average area per unit length of the remaining part of the column electrode other than the one part.

19 Claims, 16 Drawing Sheets

DISPLAY DEVICE

BACKGROUND OF THE INVENTION

1. Field of the Invention

The invention relates to a display device using a display medium the state of which is changed in accordance with an applied electric field, and more particularly to a liquid crystal display device in which a liquid crystal is used as a display medium.

2. Description of the Related Art

Conventionally, a segment liquid crystal display device using a nematic liquid crystal is widely used as, for example, a display unit of a watch or an electronic calculator. By contrast, a matrix liquid crystal display device using a nematic liquid crystal is used as a display unit of a word processor, a computer, or a navigation apparatus, and hence the market of such a liquid crystal display device is growing. Such liquid crystal display devices are very thinner and lighter than other display devices such as a CRT, and smaller in power consumption than the other display devices. In the liquid crystal display devices, furthermore, a full-color image can be easily attained. Therefore, the demand for the liquid crystal display devices is expanding in application fields which are wider than those of such other display devices. For example, the liquid crystal display devices are used as a display unit of a personal computer, various kinds of monitor apparatuses, a portable television apparatus, or a display unit of a camera.

A matrix liquid crystal display device includes a liquid crystal panel in which a plurality of pixels are arranged in a matrix form, and a liquid crystal driver which supplies an electric signal to the liquid crystal panel. In each of the pixels, a liquid crystal is sandwiched between a flat pixel electrode and a flat counter electrode. Among matrix liquid crystal display devices, particularly, an active matrix liquid crystal display device in which an active element is used as a switching element is frequently used. For example, the active element is realized by a thin film transistor (hereinafter, often abbreviated as "TFT").

A liquid crystal panel of a prior art active matrix liquid crystal display device using TFTs is structured in the following manner. The liquid crystal panel includes in addition to the plurality of pixels, a main substrate and an counter substrate which transmit light, reference signal lines, TFTs the number of which is equal to the total number of the pixels, a plurality of scanning signal lines, and a plurality of gradation signal lines. Counter electrodes of all the pixels are arranged in a matrix form on one face of the counter substrate, and electrically connected to one another via the reference signal lines. The counter electrodes of all the pixels, and the reference signal lines are integrally formed into a single thin film of a conductive material which can be opposed to the pixel electrodes of all the pixels, i.e., into a common electrode.

The pixel electrodes of all the pixels are arranged on one face of the main substrate in a matrix form. The scanning signal lines are arranged on the one face of the main substrate so as to pass the peripheries of the pixel electrodes and be parallel to the row direction of the pixel arrangement. The gradation signal lines are arranged on the one face of the main substrate so as to be parallel to the column direction of the pixel arrangement. The TFTs are arranged on the one face of the main substrate. In each of the TFTs, the drain terminal is connected to one of the pixel electrodes, the gate terminal to one of the scanning signal lines, and the source terminal to one of the gradation signal lines. In the case where the liquid crystal display device can display a color image, furthermore, a color filter is disposed on the main substrate or the counter substrate. The scanning signal lines perpendicularly intersect with the gradation signal lines on the main substrate. At each of the intersections of the signal lines, the two kinds of signal lines are electrically insulated from each another so as to prevent a short circuit from occurring. The liquid crystal panel is structured as described above. In the specification, the above-described structure of the liquid crystal panel, i.e., the structure in which the counter electrodes of all the pixels are connected to the reference signal lines is referred to as "current structure."

The liquid crystal driver for the liquid crystal display device including the active matrix liquid crystal panel of the current structure supplies a scanning signal for driving the TFTs, to the TFTs through the scanning signal lines. During a period when each of the TFTs is driven, i.e., that when transmission of an electric signal between the source and drain terminals of the TFT is enabled, the liquid crystal driver supplies a display signal for defining the display state of the pixel including the pixel electrode which is connected to the TFT, to the pixel electrode via the gradation signal lines and the TFT. Furthermore, the liquid crystal driver always supplies a predetermined reference signal to the common electrode. The scanning signal and the gradation signal are pulsating signals of a voltage variable with time. In the case where the liquid crystal driver performs the so-called line inversion driving, the reference signal is a pulsating signal, and, in the case where the liquid crystal driver performs the so-called dot inversion driving, is a steady signal in which the voltage is always maintained to a predetermined level. As a result, in accordance with the voltage applied between the pixel electrode and the common electrode, the state of the liquid crystal between the electrodes is determined.

The liquid crystal panel of the thus configured prior art active matrix liquid crystal display device has the structure in which the scanning signal lines perpendicularly intersect with the gradation signal lines on the main substrate. In the liquid crystal panel, therefore, a failure such as that the signal lines of two kinds are short-circuited at the intersection may easily occur. As a result, the production yield of the prior art liquid crystal display device tends to be lower than that of a liquid crystal display device of another configuration.

In order to solve the problem, U.S. Pat. No. 4,694,287 discloses a liquid crystal panel having the so-called counter source structure. The liquid crystal panel of an active matrix liquid crystal display device of the prior art using TFTs and having the counter source structure is structured in the following manner. The liquid crystal panel of the counter source structure includes in addition to the plurality of pixels, an counter substrate and a main substrate which are optically transparent, gradation signal lines, TFTs the number of which is equal to the total number of the pixels; scanning signal lines, and reference signal lines.

Counter electrodes of all the pixels are arranged in a matrix form on one face of the counter substrate. The gradation signal lines are arranged on the one face of the counter substrate so as to pass the peripheries of the counter electrodes and be parallel to the column direction of the pixel arrangement. The counter electrodes of two or more of all the pixels which constitute one arbitrary column of the arrangement are electrically connected to an arbitrary one of the gradation signal lines which passes the vicinity of the column. The arbitrary gradation signal line, and all the counter electrodes connected to the signal line are integrally formed so as to constitute a single strip-like thin film piece which can be opposed to the electrodes of the pixels, and which is made of an electrically conductive material, i.e., a column electrode. As a result, a plurality of column electrodes are arranged on the one face of the counter substrate.

The pixel electrodes of all the pixels are arranged on the one face of the main substrate in a matrix form. The scanning signal lines and the reference signal lines are arranged on the one face of the main substrate so as to pass the peripheries of the pixel electrodes and be parallel to the row direction of the pixel arrangement. The TFTs are arranged on the one face of the main substrate. In each of the TFTs, the drain terminal is connected to one of the pixel electrodes, the gate terminal to one of the scanning signal lines, and the source terminal to one of the reference signal lines. The gradation signal, the scanning signal, and the reference signal are supplied to the gradation signal lines, the scanning signal lines, and the reference signal lines, respectively. The liquid crystal panel of the counter source structure is structured as described above.

Japanese Unexamined Patent Publication JP-A 4-219735 (1992) discloses a configuration for, in a liquid crystal panel of the counter source structure, preventing a so-called DC-level shift from occurring. In the liquid crystal display device disclosed in the publication, a capacitor is interposed between a reference potential supply bus line and a display electrode, i.e., between the reference signal line and the pixel electrode. Japanese Unexamined Patent Publication JP-A 7-20495 (1995) discloses a configuration for, in a liquid crystal panel of the counter source structure, eliminating capacitive coupling which may be produced by a column electrode on an counter substrate and a reference signal line on a main substrate. In the liquid crystal display device disclosed in the publication, a transparent electrode which is opposed to a plurality of pixel electrodes via a liquid crystal layer, i.e., the column electrode is configured by a plurality of first transparent electrodes which are opposed only to the plurality of pixel electrodes, respectively, and an electrically conductive layer through which the first transparent electrodes are connected to one another, and which is smaller in width than the first transparent electrodes.

Among regulations relating to an image display device which is to be used as a display unit of an information apparatus, there are standards for EMI (unwanted radiation) of high-frequency waves. Such standards for regulating EMI are originally set with the objective of protecting a radio apparatus, and differently defined in countries. Recently, there arises a fear that, in addition to EMI of high-frequency waves, a so-called leakage low-frequency electromagnetic field may adversely affect the human body. Under such circumstances, regulations for a leakage low-frequency electromagnetic field are set in the countries of northern Europe. Such regulations are expanding to many countries in the world. As one of regulations for a leakage low-frequency electromagnetic field from an image display device, TCO standard is widely known. The TCO standard is a standard conforming to measurement standard MPR-II for a VDU (Visual Display Unit) which is set by SWEDAC (Swedish board for technical accreditation). In the TCO standard, it is defined that a leakage low-frequency electromagnetic field is measured in accordance with Swedish standard SS436 14 90 and IEEE 1140-1994.

Since standards for a leakage low-frequency electromagnetic field of an image display device are set as described above, a liquid crystal display device which is to be used as an image display device for an information apparatus must be designed so that the leakage low-frequency electromagnetic field meets the standards. In order to comply with this, for example, a liquid crystal display device is structured so that a film for shielding an electromagnetic field is applied to the surface of a liquid crystal panel. Japanese Unexamined Patent Publication JP-A 5-61019 (1993) discloses a technique of reducing electromagnetic field radiation from a display panel of an AC-driven flat display device. In a liquid crystal display panel disclosed in the publication, an electrode for reducing electromagnetic field radiation is disposed in the periphery of the panel, and a voltage which is opposite in polarity to an alternating voltage that is to be supplied to a common electrode in the panel is applied to electrode for reducing electromagnetic field radiation.

The inventor of the present invention has measured a leakage low-frequency electromagnetic field, with respect to prior art liquid crystal display devices of the current structure and the counter source structure in which a countermeasure for reducing a leakage low-frequency electric field is not taken (hereinafter, such a liquid crystal display device is often referred to as "untreated LCD"), in accordance with measurement standard MPR-II described above, and compared measurement results with the TCO standard. From the results, it is expected that a leakage low-frequency electric field of an untreated LCD has the following general features.

The results of the measurement on an untreated LCD of the current structure have revealed that, when the frequency of a signal supplied to the LCD is in band I, the low-frequency magnetic field and the low-frequency electric field are set within the allowable range of the TCO standard, and that, when the frequency of the supplied signal is in band II, the low-frequency electric field is hardly set within the allowable range of the TCO standard. Based on the measurement results and considering that the frequency of a signal supplied to a liquid crystal panel is approximately in a range of from 15 kHz or higher to 55 kHz, it is expected that a leakage low-frequency electric field in a liquid crystal display device is caused mainly by a voltage change of a signal supplied to a component on the counter substrate.

The results of the measurement on an untreated LCD of the counter source structure have revealed also that, when the amplitude waveform of the AC component of the reference signal is opposite in phase to that of the AC component of the gradation signal, the low-frequency electric field is weaker as the amplitude of the reference signal is higher. Based on the measurement results, it is expected that, when a signal which is opposite in phase to a signal supplied to a component on the counter substrate is supplied to a component on the main substrate, an effect of canceling the signals occurs to weaken the leakage low-frequency electric field of the liquid crystal display device. From the measurement results, it has been revealed that, in the untreated LCDs of the two kinds of structures, the leakage low-frequency electric field has a dependency on the size of the panel. Namely, in the untreated LCD, the leakage low-frequency electric field is stronger as the liquid crystal panel is larger. Based on the measurement results, it is expected that the leakage low-frequency electric field of a liquid crystal display device is stronger as the area of a component which is on the counter substrate and to which a signal is to be input is larger.

On the basis of the measurement results, it has been proposed that, in a prior art liquid crystal display device of the current structure, the dot inversion driving be used in place of the line inversion driving in order to set the leakage low-frequency electric field within the allowable range of the TCO standard, because of the following reason. In the case where the line inversion driving is used, the reference signal that is supplied to a component on the counter substrate is a pulsating signal in which the voltage is changed so as to assist the gradation signal that is supplied to a component on the main substrate. When the line inversion driving is used in the liquid crystal display device, therefore, it becomes difficult to set the leakage low-frequency electric field within the reference value range of the TCO standard, as the size of the liquid crystal panel becomes larger. In the case where the dot inversion driving is used, the reference signal a steady signal, and hence the voltage of the reference signal that is supplied to a component on the counter substrate is not changed, and hence it is expected that the leakage low-frequency electric field is weaker than that in the case where the line inversion driving is used. Therefore, the dot inversion driving is used in order to make the leakage low-frequency electric field lower.

As described above, in order to make the leakage low-frequency electric field lower, a prior art liquid crystal display device is configured so that a film for shielding an electromagnetic field is applied to a liquid crystal panel, or that an electrode for reducing electromagnetic field radiation and a unit for applying a voltage to the electrode are added to a liquid crystal panel. As a result, a process of producing the liquid crystal display device includes a step of attaching a member for attaining shielding of a leakage low-frequency electric field and circuit components accompanying the member, to the liquid crystal panel. Therefore, the number of production steps is larger than that in a process of producing an untreated LCD. Furthermore, the production yield of such a liquid crystal display device is lower than that of an untreated LCD. As a result, the production cost of the liquid crystal display device is higher than that of an untreated LCD. In the liquid crystal display device, the addition of the member for shielding a leakage low-frequency electric field and circuit components accompanying the member may cause the transmittance of the liquid crystal panel to be lower than that of an untreated LCD. Therefore, the liquid crystal display device is lower in display quality than an untreated LCD.

As described above, in order to set the leakage low-frequency electric field within the allowable range of the TCO standard, the prior art liquid crystal display device of the current structure uses the dot inversion driving technique. A driver for the dot inversion driving is more complex in structure and production process than that for the line inversion driving, and requires a complicated production process. Therefore, a driver for the dot inversion driving is more expensive than that for the line inversion driving. In the prior art liquid crystal display device of the current structure which uses the dot inversion driving technique, the device cost is higher than that of an untreated LCD of the current structure. The prior art liquid crystal display device having the counter source structure is configured so that, when the dot inversion driving is to be performed, the gradation signal is supplied to a component on the counter substrate, i.e., the column electrodes, and hence a steady signal is never supplied to the component. In the prior art liquid crystal display device having the counter source structure, even when the driving technique is improved, therefore, it is difficult to suppress a leakage low-frequency electric field.

SUMMARY OF THE INVENTION

It is an object of the invention to provide a display device capable of reducing a leakage low-frequency electric field can be reduced while preventing an increase in production cost and impairment in display quality.

In a first aspect of the invention a display device comprising:

a panel section including a plurality of pixel electrodes which are arranged in a predetermined reference plane, a display medium layer consisting of a display medium whose state relating to a display is changed in accordance with an electric field, and a single common electrode which is opposed to all the pixel electrodes via the display medium layer;

gradation signal supplying means for supplying a gradation signal of a voltage which varies with time, to the respective pixel electrodes, in order to define the electric field for controlling the state of the display medium interposed between the pixel electrodes and the counter electrodes,; and reference signal supplying means for supplying a reference signal of a voltage which varies in a predetermined pattern with time, to the common electrode, a difference Vbpp between maximum and minimum voltages of the reference signal, being equal to or smaller than a first upper limit voltage difference VMAX1 which is defined by an area x [$m^2$] of the common electrode as follows:

$$VMAX1=0.3578\times x^{-0.6156}[V]$$

According to the first aspect of the invention, the display device comprises the panel section in which the pixel electrodes are opposed to the single common electrode via the display medium layer, i.e., the panel section of the current structure, and the voltage difference Vbpp of the reference signal which is supplied from the reference signal supplying means of the display device to be applied to the common electrode is restricted to a value which is not more than $0.3578\times x^{-0.6156}$ [V] (wherein x is the area [$m^2$] of the common electrode) and not less than 0 V. In the display device of the invention, therefore, a leakage low-frequency electric field caused by the reference signal and produced from the panel section in the device can be surely suppressed to the upper limit reference value of a leakage low-frequency electric field defined in the TCO standard or less, only by adjusting the voltage difference Vbpp of the reference signal. The structure and the production process of the panel section in the display device of the invention can be made identical with those of a panel section of the prior art. In the display device of the invention, therefore, a leakage low-frequency electric field from the panel section can be suppressed very easily, and increases of the production cost and the number of components of the panel section, and impairment of the yield which may be caused by a countermeasure for suppressing the leakage low-frequency electric field can be prevented from occurring.

In a second aspect of the invention it is preferable that the panel section further includes:

gradation signal lines interposed between the gradation signal supplying means and the pixel electrodes;

switching elements interposed between the gradation signal lines and the pixel electrodes, respectively; and scanning signal lines for supplying an opening/closing signal to the switching elements to control an opening/closing state of each of the switching elements.

According to the second aspect of the invention, the display device has the same configuration as that of the display device according to the first aspect of the invention, and the panel section further includes the above-mentioned components. As a result, the panel section is formed as an active matrix panel section having the current structure. In the display device of the second aspect, therefore, a leakage low-frequency electric field caused by the reference signal and produced from the panel section which can display an image configured by a plurality of pixels can be surely suppressed to the upper limit reference value of a leakage low-frequency electric field defined in the TCO standard or less, only by adjusting the voltage difference Vbpp of the reference signal. Consequently, the display device according to the second aspect of the invention can be suitably used as an image display device for an information apparatus.

In a third aspect of the invention a display device comprises:

a panel section including a plurality of pixel electrodes which are arranged in a predetermined reference plane; a display medium layer consisting of a display medium whose state relating to a display is changed in accordance with an electric field; and a plurality of counter electrodes which are opposed to the pixel electrodes via the display medium layer, respectively;

reference signal supplying means for supplying a reference signal of a voltage which varies in a predetermined pattern with time, to all of the pixel electrodes; and gradation signal supplying means for supplying a gradation signal of a voltage variable with time, to the respective counter electrodes in order to define the electric field for controlling the state of the display medium interposed between the pixel electrodes and the counter electrodes, a difference Vspp between maximum and minimum voltages of the gradation signal, which is equal to or smaller than a second upper limit voltage difference VMAX2 which is defined by an area x [$m^2$] of a predetermined display region where all the pixel electrodes can be arranged, and a ratio y of an area of all the counter electrodes to the area x of the display region as follows:

$$VMAX2=a\times x^{-b}[V]$$

wherein $a=0.3565\times y^{-0.6829}$ $b=-0.0937y+0.7091$

According to the third aspect of the invention, the display device has the panel section in which pixel electrodes are opposed to the counter electrodes via the display medium layer, respectively. In the liquid crystal panel having the above-mentioned structure, the structure of portions relating to the pixel electrodes and components disposed in the periphery of the pixel electrodes is simpler than that of a liquid crystal panel having the current structure, and the production cost of the panel section is lower than that of a panel section having the current structure. The reliability of the panel section after production is improved. Furthermore, a component which is in the panel section having the above-mentioned structure, and to which an electric signal functioning as a main cause of a leakage low-frequency electric field is supplied is smaller in area than that which is in the panel section having the current structure, and to which an electric signal functioning as a main cause of a leakage low-frequency electric field is supplied. In the display device according to the third aspect of the invention, therefore, the leakage low-frequency electric field from the panel section can be reduced more easily than that in a display device having a panel section of the current structure.

In the display device according to the third aspect of the invention, the voltage difference Vspp of the gradation signal which is supplied from a gradation signal supplying section to be applied to the counter electrodes is restricted to a value which is $a\times x^{-b}$ [V] {wherein $a=0.3565\times y^{-0.6829}$, $b=-0.0937y+0.7091$, x is the area of the display region, and y is a ratio of the area of all the counter electrode to that of the display region} or less and not less than 0 V. In the display device, therefore, a leakage low-frequency electric field caused by the gradation signal and produced from the panel section of the device can be surely suppressed to the upper limit reference value of a leakage low-frequency electric field defined in the TCO standard or less, only by adjusting the voltage difference Vspp of the gradation signal. The structure and the production process of the panel section in the display device according to the third aspect of the invention can be made identical with those of a panel section of the prior art having the above-mentioned structure. In the display device according to the third aspect of the invention, therefore, a leakage low-frequency electric field from the panel section can be suppressed very easily, and increases of the production cost and the number of components of the panel section, and impairment of the yield which may be caused by a countermeasure for suppressing the leakage low-frequency electric field can be prevented.

In a fourth aspect of the invention a display device comprises:

a panel section including a plurality of pixel electrodes which are arranged in a predetermined reference plane, a display medium layer consisting of a display medium whose state relating to a display is changed in accordance with an electric field, and a plurality of counter electrodes which are opposed to the pixel electrodes via the display medium layer, respectively;

reference signal supplying means for supplying a reference signal of a voltage which varies in a predetermined pattern with time, to all the pixel electrodes; and gradation signal supplying means for supplying a gradation signal of a voltage variable with time, to each of the counter electrodes in order to define the electric field for controlling the state of the display medium interposed between the pixel electrodes and the counter electrodes, a difference Vdyn between a voltage between the pixel electrodes and the counter electrodes in the case where an electric field for setting the state of the display medium to a predetermined first state is defined, and a voltage between the pixel electrodes and the counter electrodes in the case where an electric field for setting the state of the display medium to a second state which is different from the first state is defined, being equal to or smaller than a third upper limit voltage difference VMAX3 which is defined by an area x [$m^2$] of a predetermined display region where all the pixel electrodes can be arranged, and a ratio y of an area of all the counter electrode to the area x of the display region as follows:

$$VMAX3=a\times x^{-b}[V]$$

wherein $a=0.3565\times y^{-}0.6829$ $b=-0.0937y+0.7091$

According to the fourth aspect of the invention, the display device has the panel section in which pixel electrodes are opposed to the counter electrodes via the display medium layer, respectively. In the display device according to the fourth aspect of the invention, because of the same reason as that of the display device according to the third aspect of the invention, the structure of portions relating to the pixel electrodes and components disposed in the periphery of the pixel electrodes is simple, and the production cost of the panel section is lower than that of a panel section having the current structure. Furthermore, the reliability of the panel section after the production is improved. In the display device according to the fourth aspect of the invention, therefore, the leakage low-frequency electric field from the panel section can be reduced more easily than that in a display device having a panel section of the current structure.

In the display device according to the fourth aspect of the invention, the difference Vdyn of the voltages between the pixel electrodes and the counter electrodes for respectively defining two kinds of electric fields for setting the display medium in the panel section to two different kinds of states is restricted to a value which is $a \times x^{-b}$ [V] {wherein $a=0.3565 \times y^{-0.6829}$, $b=-0.0937y+0.7091$, x is the area of the display region, and y is a ratio of the area of all the counter electrode to that of the display region} or lower and not less than 0 V. The difference Vspp between the maximum and minimum voltages of the gradation signal in the display device is always smaller than the upper limit VMAX3 of the difference Vdyn between the voltages for defining the electric field. In the display device according to the fourth aspect of the invention, therefore, a leakage low-frequency electric field caused by the gradation signal and produced from the panel section can be surely suppressed to the upper limit reference value of a leakage low-frequency electric field defined in the TCO standard or less, only by adjusting the configuration of the panel section for defining the difference Vdyn between the voltages for defining the electric field. The structure and the production process of the panel section in the display device according to the fourth aspect of the invention can be made identical with those of a panel section of the prior art having the above-mentioned structure. In the display device according to the fourth aspect of the invention, therefore, a leakage low-frequency electric field from the panel section can be suppressed very easily, and increases of the production cost and the number of components of the panel section, and impairment of the yield which may be caused by a countermeasure for suppressing the leakage low-frequency electric field can be prevented from occurring.

In a fifth aspect of the invention, it is preferable that the panel section further includes gradation signal lines which are interposed between the gradation signal supplying means and the counter electrodes, and reference signal lines which are interposed between the reference signal supplying means and the pixel electrodes, and the gradation signal lines are disposed in a relation of skew position with respect to the reference signal lines, respectively.

According to the fifth aspect of the invention, the display device has the same configuration as that of the display device according to the third or fourth aspect, and the panel section further includes the above-mentioned components. As a result, the panel section is formed as a so-called active matrix panel section. When an arbitrary gradation signal line and all opposed electrodes connected to the gradation signal line are integrated with one another and an arbitrary reference signal line and all pixel electrodes connected to the reference signal line are integrated with one another, the panel section is formed as a so-called simple matrix panel section. In the display device according to the fifth aspect of the invention, therefore, a leakage low-frequency electric field caused by the gradation signal and produced from the matrix panel which can display an image configured by a plurality of pixels can be surely suppressed to the upper limit reference value of a leakage low-frequency electric field defined in the TCO standard or less, only by adjusting the voltage difference Vspp of the gradation signal or the difference Vdyn between the voltages for defining the electric field. Consequently, the display device according to the fifth aspect of the invention can be suitably used as an image display device for an information apparatus.

In a sixth aspect of the invention, it is preferable that the gradation signal lines and the counter electrodes connected thereto are integrated to form an electrically conductive portion, and an area per unit length of a first part of the electrically conductive portion is smaller than an area per unit length of a remaining part of the electrically conductive portion other than the first part, the first part being opposed to the reference signal lines.

According to the sixth aspect of the invention, the display device has the same configuration as that of the display device according to the fifth aspect of the invention, and the panel section is configured as described above. As a result, in the panel section of the display device according to the sixth aspect of the invention, an electrical shielding member which is opposed to the reference signal lines is reduced as compared with the panel section of the prior art in which the area per unit length of the first part is equal to that of the remaining part. As a result, the effect of canceling a leakage low-frequency electric field caused by the reference signal in the panel section in the display device according to the sixth aspect of the invention is greater than that of canceling a leakage low-frequency electric field caused by the reference signal in the panel section of the prior art. Consequently, a leakage low-frequency electric field caused by the gradation signal lines and produced from the panel section of the display device according to the sixth aspect of the invention is further reduced as compared with a leakage low-frequency electric field of a liquid crystal display device including the panel section of the prior art.

As a result, the cross capacitance of the first part in the panel section of the display device according to the sixth aspect of the invention is smaller than that of the first part in the panel section having the counter source structure of the prior art. In the display device according to the sixth aspect of the invention, therefore, delays of the gradation signal and reference signal are reduced in degree as compared with the case of the panel section having the counter source structure of the prior art. Because of these reasons, the display device according to the sixth aspect of the invention can be made higher in display quality than the prior art display device including a panel section having the counter source structure.

In a seventh aspect of the invention, it is preferable that the electrically conductive portion has a substantially strip-like shape, and a hole is opened in the first part in the electrically conductive portion.

According to the seventh aspect of the invention, the display device has the same configuration as that of the display device according to the sixth aspect of the invention, and the electrically conductive portion is configured as described above. As a result, in the panel section of the display device according to the seventh aspect of the invention, parts in the conductive portion and located on the both sides of the first part are connected to each other through a plurality of film pieces which remain in the first part of the electrically conductive portion. In the case where any one of the plurality of film pieces in the first part is broken, therefore, the two remaining parts are electrically connected to each other through remaining parts. Namely, in this case, the electrically conductive portion is hardly broken. This is preferable.

In an eighth aspect of the invention, it is preferable that the panel section further includes a plurality of switching elements which are interposed between the reference signal lines and the pixel electrodes, respectively, and scanning signal lines for supplying an opening/closing signal to the switching elements to control an opening/closing state of each of the switching elements, and the scanning signal lines are disposed in a relation of skew position with respect to the gradation signal lines, respectively.

According to the eighth aspect of the invention, the display device has the same configuration as that of the display device according to the fifth aspect of the invention, and the panel section further includes the above-mentioned components. As a result, the panel section is formed as an active matrix panel section having the so-called counter source structure. In the display device according to the eighth aspect of the invention, therefore, a leakage low-frequency electric field caused by the gradation signal and produced from the panel section which can display an image configured by a plurality of pixels can be surely suppressed to the reference value of a leakage low-frequency electric field defined in the TCO standard or less, only by adjusting the voltage difference Vspp of the gradation signal. Consequently, the display device according to the eighth aspect of the invention can be suitably used as an image display device for an information apparatus.

In a ninth aspect of the invention, it is preferable that the gradation signal lines and the counter electrodes connected thereto are integrated to form an electrically conductive portion, and an area per unit length of a second part of the electrically conductive portion is smaller than an area per unit length of a remaining part of the electrically conductive portion other than the second part, the second part being opposed to the scanning signal lines.

According to the ninth aspect of the invention, the display device has the same configuration as that of the display device according to the eighth aspect of the invention, and the panel section is configured as described above. As a result, the area of the second part in the electrically conductive portion of the panel section according to the ninth aspect of the invention is smaller than that of the second part in the panel section having the counter source structure of the prior art. Therefore, a leakage low-frequency electric field from the panel section of the display device according to the ninth aspect of the invention is further reduced. As a result, the cross capacitance of the second part in the panel section is smaller than that of the second part in the panel section having the counter source structure of the prior art. In the display device according to the ninth aspect of the invention, therefore, delays of the gradation signal and scanning signals are reduced in degree as compared with the case of the panel section having the counter source structure of the prior art. Consequently, the display device according to the ninth aspect of the invention can be made higher in display quality than the prior art display device including a panel section of the counter source structure.

In a tenth aspect of the invention, it is preferable that the electrically conductive portion has a substantially strip-like shape, and a hole is opened in the second part in the electrically conductive portion.

According to the tenth aspect of the invention, the display device has the same configuration as that of the display device according to the ninth aspect of the invention, and the electrically conductive portion is configured as described above. In the display device according to the tenth aspect of the invention, because of the same reason as that of the display device according to the seventh aspect, the electrically conductive portion is hardly broken, which is advantageous.

In an eleventh aspect of the invention, it is preferable that the display medium is a liquid crystal.

According to the eleventh aspect of the invention, the liquid crystal display device has the same configuration as that of the display devices according to the first to tenth aspects of the invention, and the display medium layer is formed by a liquid crystal. The panel section of the liquid crystal display device may be either of the so-called transmission type or the so-called reflection type. As a result, in the liquid crystal display device, the panel section is thinner and lighter, and smaller in power consumption than another display device such as a CRT. Furthermore, a leakage low-frequency electric field produced from the panel section can be suppressed to the upper limit reference value of the TCO standard or less. Consequently, the liquid crystal display device according to the eleventh aspect of the invention can be suitably used as an image display device for an information apparatus.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
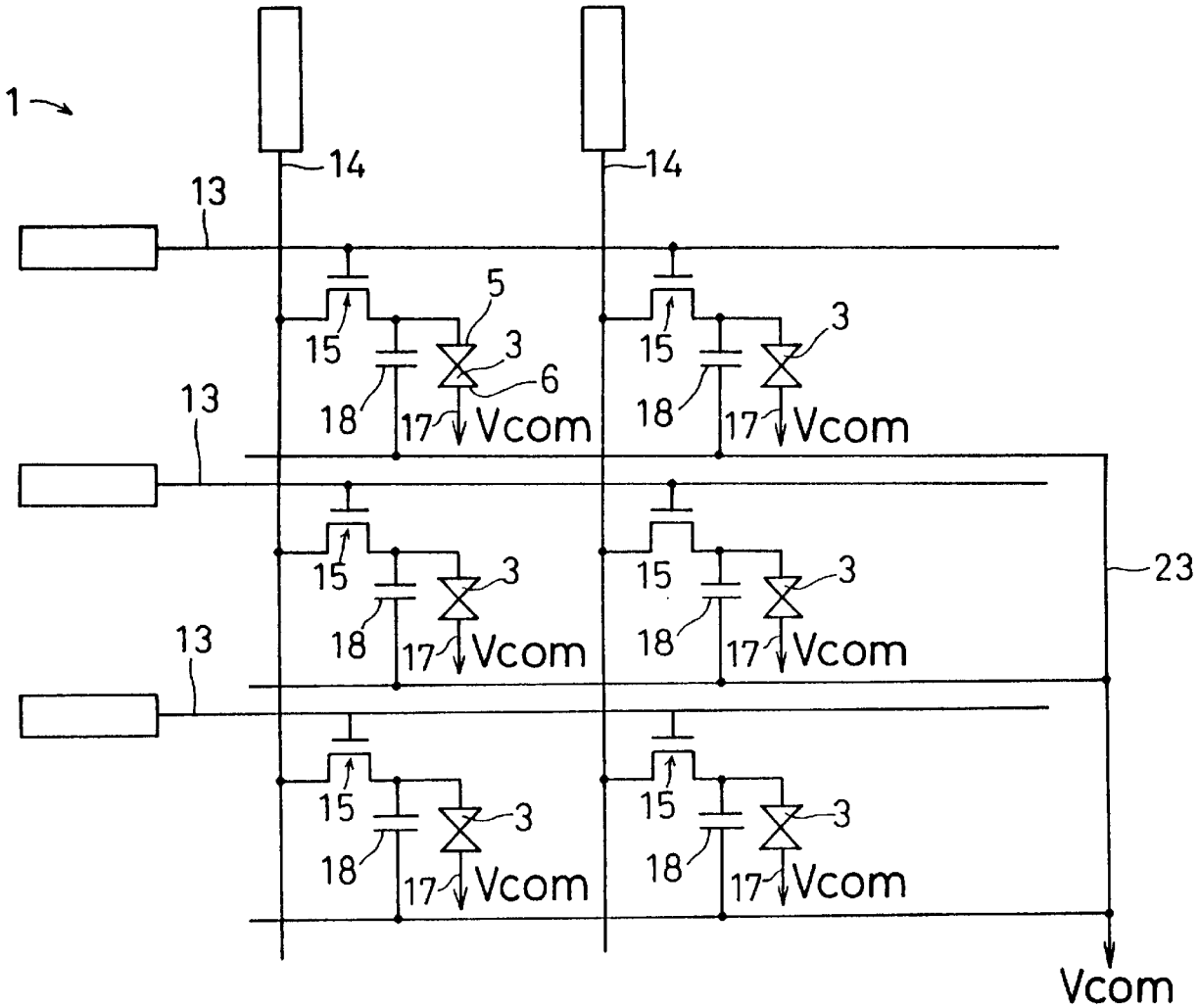
FIG. 1 is an equivalent circuit diagram of a panel section 1 of a liquid crystal display device which is a first embodiment of the invention.

Now referring to the drawings, preferred embodiments of the invention are described below.

Figure 2:
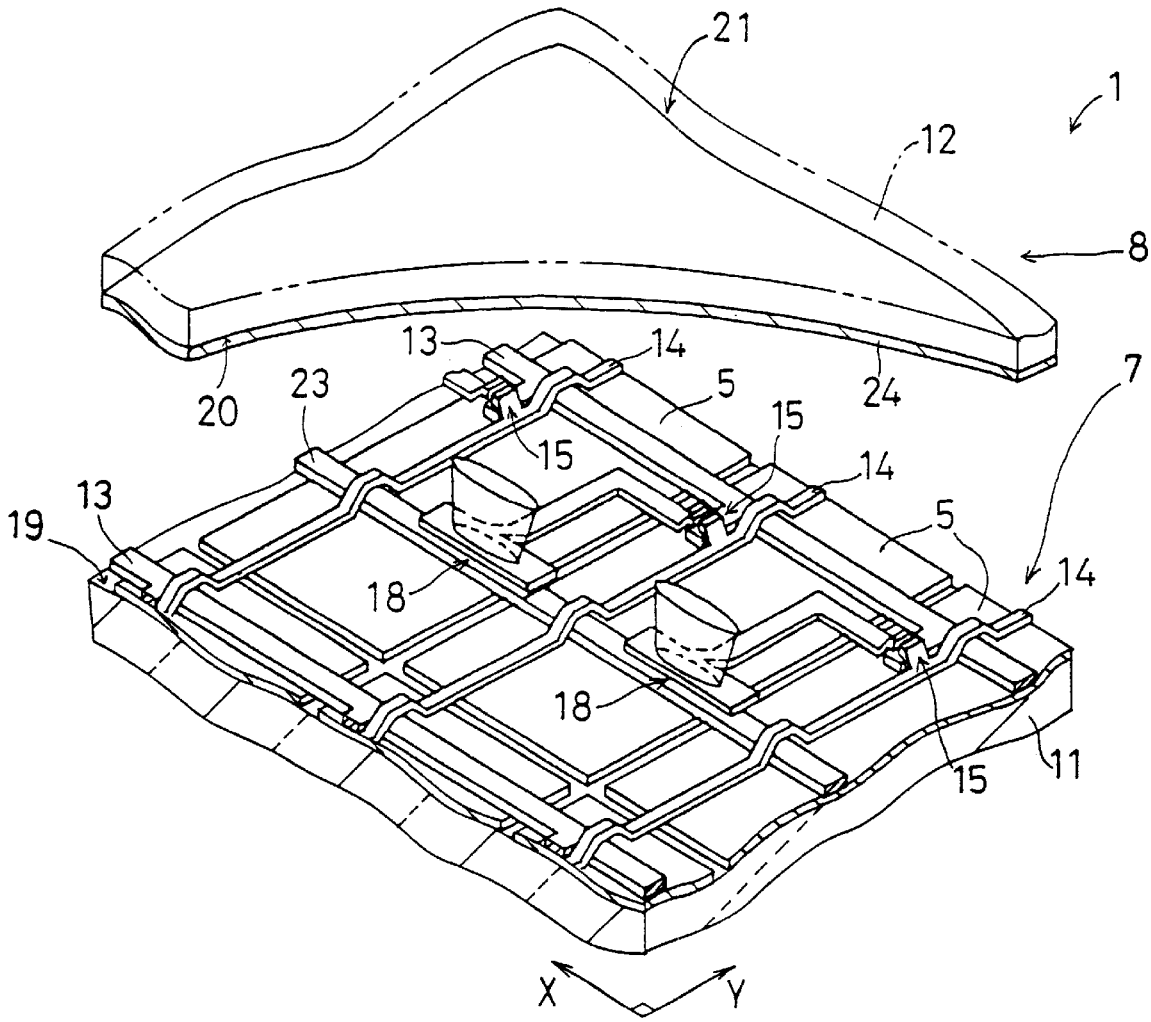
FIG. 2 is a partial enlarged perspective view specifically showing the configuration of the panel section 1 of the liquid crystal display device of the first embodiment.

FIG. 1 is an equivalent circuit diagram of a panel section 1 of a liquid crystal display device of a first embodiment of the invention, and FIG. 2 is a partial perspective view of the panel section 1 of FIG. 1. The description will be given with reference to both FIGS. 1 and 2. The liquid crystal display device includes, in addition to the panel section 1, a driver for supplying an electric signal for displaying to the panel section 1. The panel section 1 basically includes pixels 3. Each of the pixels 3 is configured by interposing a liquid crystal layer between a flat pixel electrode 5 and a flat counter electrode 6. In the embodiment, the panel section 1 includes a plurality of pixels 3. The panel section 1 of the embodiment is a panel section of the active matrix type in which three-terminal active elements are used as switching elements, and which has the current structure. In the embodiment, thin film transistors (hereinafter, often abbreviated as "TFTs") are used as the three-terminal active elements.

The panel section 1 having the current structure is divided into a main substrate section 7, an counter substrate section 8, and a liquid crystal section. The main substrate section 7 includes in addition to the pixel electrodes 5 of all the pixels 3: a main substrate 11; scanning signal lines 13; gradation signal lines 14; TFTs 15 the number of which is equal to the total number of the pixels 3; addition capacitor portions 18 the number of which is equal to the total number of the pixels 3; and one orientation film. The counter substrate section 8 includes in addition to the counter electrodes 6 of all the pixels 3: an counter substrate 12; reference signal lines 17; and one orientation film. In the embodiment, it is assumed that the panel section includes a plurality of scanning signal lines 13 and a plurality of gradation signal lines 14. The liquid crystal section in which the liquid crystal layers of all the pixels 3 are integrated with one another has a flat plate-like shape, and is disposed between the main substrate section 7 and the counter substrate section 8. In FIG. 1, the panel section 1 includes six pixels 3 arranged in three rows and two columns, and components other than the upper left pixel 3 and peripheral components of the pixel 3 are not denoted by reference numerals. In FIG. 2, the liquid crystal layer is not shown, and a part of the counter substrate section 8 is cut away.

At least all the pixel electrodes 5 are arranged on one face 19 of the main substrate 11. At least all the counter electrodes 6 are arranged on one face 20 of the counter substrate 12. The main substrate 11 and the counter substrate 12 are placed in such a manner that the substrates are parallel to each other, and separated from each other by a predetermined gap, and also that the faces 19 and 20 of the substrates 11 and 20 are opposed to each other. The panel section 1 is used in such a manner that the side of the counter substrate section 8 opposite to the face which is directed to the liquid crystal layer serves as a display face 21. The region of the panel section 1 where all the pixels 3 of the display face 21 are arranged as seen from the direction of the normal to the display face 21 is often referred to as "display region."

All of the scanning signal lines 13, the gradation signal lines 14, the pixel electrodes 5, and the TFTs 15 are arranged on the one face 19 of the main substrate 11 in the following manner. The plurality of scanning signal lines 13 are arranged so as to be parallel to one another and separated with forming predetermined gaps therebetween. The plurality of gradation signal lines 14 are arranged in a direction perpendicular to the longitudinal direction of the scanning signal lines, so as to be parallel to one another and separated with forming predetermined gaps therebetween. As a result, the scanning signal lines 13 and the gradation signal lines 14 perpendicularly intersect with one another on the main substrate 11. The scanning and gradation signal lines 13 and 14 are electrically insulated from one another so that the signal lines 13 and 14 are not short-circuited with each other at the intersections of the two signal lines. In order to attain the insulation, for example, an insulating layer is interposed between the scanning signal lines 13 and the gradation signal lines 14.

The pixel electrodes 5 of all the pixels 3 are arranged in parallel in both the longitudinal direction of the scanning signal lines 13 and a direction perpendicular to the longitudinal direction, with the result that the pixel electrodes 5 are arranged in a matrix form. In the specification, among a plurality of elements which are arranged in a matrix form, a group of elements which are arranged in the longitudinal direction X of the scanning signal lines 13 are often generally called "row," and a group of elements which are arranged in a direction perpendicular to the longitudinal direction X are often generally called "column." The rows of the pixel electrodes 5 are equal in number to the scanning signal lines 13, and the columns of the pixel electrodes 5 are equal in number to the gradation signal lines 14. Namely, each of the rows of the pixel electrodes 5 is placed adjacent to corresponding one of the scanning signal lines 13, and each of the columns of the pixel electrodes 5 is placed adjacent to corresponding one of the gradation signal lines 14.

The TFTs 15 are placed in the vicinities of the pixel electrodes 5, respectively. In each of the TFTs 15, one of the drain and source terminals is connected to the pixel electrode 5 in the vicinity of the TFT 15, and the other one of the drain and source terminals is connected to one of the gradation signal lines 14 in the vicinity of the pixel electrode 5. The gate terminal of the TFT 15 is connected to one of the scanning signal lines 13 in the vicinity of the pixel electrode 5.

Each of the addition capacitor portions 18 has a structure in which one electrode and another electrode are stacked via an insulating layer, and placed in the vicinity of corresponding one of the pixel electrodes 5 on the one face of the main substrate. The one electrode of each of the addition capacitor portions 18 is connected to one of the drain and source terminals of corresponding one of the TFTs 15. The other electrodes of the addition capacitor portions 18 are connected to a single common signal line 23. For example, the common signal line 23 is placed on the one face 19 of the main substrate 11.

Among the scanning signal lines 13, the gradation signal lines 14, the TFTs 15, the addition capacitor portions 18, and the pixel electrodes 5, at least two kinds of components may be placed in a stacked manner under a state where a countermeasure for preventing a short circuit between the components from occurring is taken. As the countermeasure for preventing a short circuit, an insulating layer is interposed between the two kinds of components. The addition capacitor portions 18 may be omitted.

The counter electrode 6 of each of the pixels 3 is basically placed at a position on the one face 20 of the counter substrate 12 and opposed to the pixel electrode 5 of the pixel 3. As a result, the arrangement of all the counter electrodes 6 is basically identical with that of the pixel electrodes 5. All the counter electrodes 6 are electrically connected to one another via the reference signal lines 17. In the example of FIG. 1, all the counter electrodes 6 and the reference signal lines 17 are integrated to one another so as to form a single common electrode 24. The common electrode 24 is formed by a substantially flat-shaped thin film made of an electrically conductive material, and placed on the one face 20 of the counter substrate 12. For example, the common electrode 24 covers the whole of the area which is on the one face 20 of the counter substrate 12, and which corresponds to the display region. Each of the parts of the common electrode 24 respectively opposed to the pixel electrodes 5 corresponds to the counter electrode 6 of a pixel including the corresponding pixel electrode 5. In the following description, the part of the common electrode 24 is often referred to as "counter electrode 6."

The two orientation films are placed at positions of the main substrate section 7 and the counter substrate section 8 which are closest to the liquid crystal section, respectively. The orientation film of the main substrate section 7 covers an exposed part of the one face 19 of the main substrate 11, and all the components 5, 13 to 15, and 18 on the one face 19, and that of the counter substrate section 8 covers an exposed part of the one face 20 of the counter substrate 12, and all the components on the one face 20, i.e., the common electrode 24. The orientation films define the orientation states of liquid crystal molecules in the liquid crystal layer during the period when no voltage is applied between the pixel electrode 5 and the counter electrode 6, or during the no-voltage application time period.

In the case where the liquid crystal layer is formed by a so-called nematic liquid crystal and the panel section 1 is of the so-called TN type or STN type, the panel section 1 further includes two polarizing plates. The two polarizing plates are placed in parallel to each other with interposing therebetween a cell section which is configured by the main substrate section 7, the counter substrate section 8, and the liquid crystal section. In the case where the panel section 1 is of the so-called normally white display type, the polarization axes of the two polarizing plates are parallel to the orientation directions of the orientation films of the substrate sections 7 and 8 which are placed between the polarizing plates and the liquid crystal section, respectively. In the case where the panel section 1 is of the so-called normally black display type, the polarization axis of one of the two polarizing plates is parallel to the orientation direction of the orientation film of the substrate section which is placed between the one polarizing plate and the liquid crystal section, and that of the other one of the two polarizing plates is perpendicular to the orientation direction of the orientation film of the substrate section which is placed between the other polarizing plate and the liquid crystal section. In the above case, therefore, an arbitrary one of the pixels 3 in the panel section 1 further includes a portion which is in the two polarizing plates and opposed to the pixel electrode 5 in the pixel 3, in addition to the pixel electrode 5, the counter electrode 6, and the liquid crystal layer.

In the case where the panel section 1 is of the transmission type, at least the main substrate 11, the counter substrate 12, all the pixel electrodes 5, all the counter electrodes 6, and the two orientation films are optically transparent, and a light source is disposed in the vicinity of the face of the panel section 1 which is on the side opposite to the display face 21. In the case where the panel section 1 is of the reflection type, at least the counter substrate 12, all the counter electrodes 6, and the orientation film of the counter substrate section 8 are optically transparent. In this case, a reflector plate may be disposed in the vicinity of the face of the panel section 1 which is on the side opposite to the display face 21. The pixel electrodes 5 may be formed by an electrically conductive material which can reflect light, so as to function also as a reflector plate. In the case where the liquid crystal display device can display a color image, a color filter is disposed on the main substrate 11 or the counter substrate 12. The panel section 1 of the current structure is configured as described above.

The driver in the liquid crystal display device drives the panel section 1 by the line inversion driving or the dot inversion driving. The operation of the driver will be briefly described. The driver always supplies the predetermined reference signal to the common electrode 24. In the case where the driver performs the line inversion driving, the reference signal is a pulsating signal of a voltage variable with time, and the variation pattern in voltage of the signal is previously determined. In the case where the driver performs the dot inversion driving, the reference signal is a steady signal in which the voltage is substantially maintained to a predetermined level irrespective of the passage of time.

The driver supplies the scanning signal for driving the TFTs 15, to the TFTs 15 via the scanning signal lines 13. Schematically speaking, the scanning signal is a pulsating signal, and the variation pattern in voltage of the signal is previously determined. The scanning signal defines each of the TFTs 15 to one of a driven state where the signal transmission between the source and drain terminals is enabled, and a suspended state where the signal transmission between the two terminals is disabled. Namely, the TFTs 15 function as switching elements, and their opening/closing states are controlled by the scanning signal.

Each of the TFTs 15 is in the driven state during only a period which is defined by the scanning signal. During a period when an arbitrary one of the TFTs 15 is in the driven state, the driver supplies the gradation signal for setting the display state of the corresponding pixel, to the gradation signal line 14 connected to the TFT 15. Schematically speaking, the gradation signal is a pulsating signal, and the variation pattern in voltage of the signal is set in accordance with the display state of the pixel. As a result, the voltage between the pixel electrode 5 connected to the arbitrary TFT 15 and the common electrode 24 is defined to a level corresponding to the display state which is to be realized by the pixel 3 including the pixel electrode 5. The state relating to the display of the liquid crystal layer, for example, the optical property of the liquid crystal layer is changed in accordance with the electric field between the pair of electrodes which are opposed to each other via the liquid crystal layer, and the electric field is defined by the voltage between the electrodes. For example, the optical property is the optical rotary power. As a result, the state relating to the display of the liquid crystal layer in the pixel 3 is defined in accordance with the electric field between the pixel electrode 5 in the pixel 3 and the counter electrode 6, i.e., the display voltage of the pixel 3.

The voltage between the pixel electrode 5 and the common electrode 24, i.e., the display voltage of the pixel 3 is maintained during the period when the TFT 15 connected to the pixel electrode 5 is in the suspended state. Furthermore, the potential of the pixel electrode 5 is maintained by the addition capacitor portion 18 connected to the TFT 15 to which the pixel electrode 5 is connected, during the suspended state of the TFT 15. Namely, the addition capacitor portion 18 is used for maintaining the voltage that is to be applied to the liquid crystal layer in the pixel 3 including the pixel electrode 5 connected to the TFT 15 to which the one electrode of the addition capacitor portion is connected, during the suspended state of the TFT 15. The operation of the driver has been briefly described.

Figure 3:
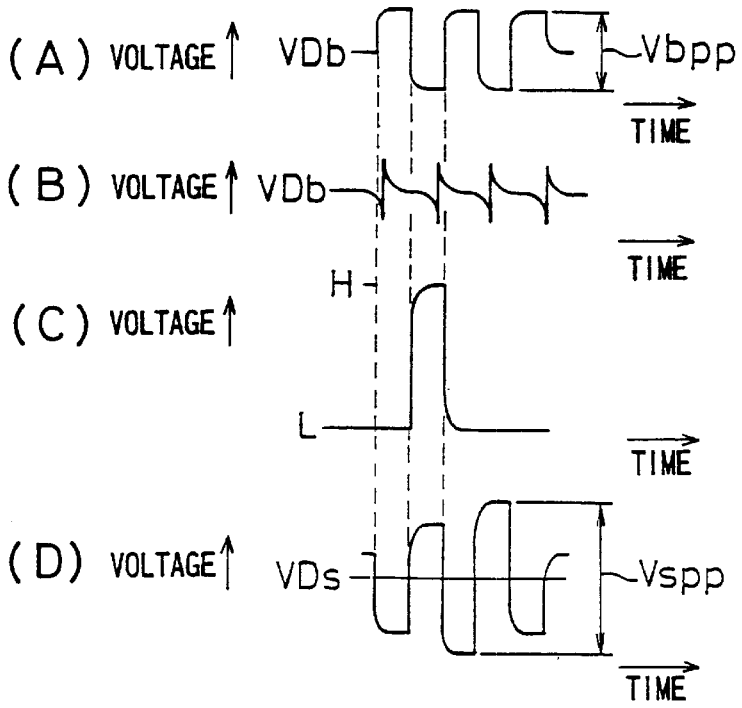
FIGS. 3(A) to 3(D) are waveform charts of a reference signal in the line inversion driving, a scanning signal, and a gradation signal in the liquid crystal display device of the first embodiment.

FIGS. 3(A) to 3(D) are waveform charts of the above-described four kinds of signals which are supplied to the panel section 1. Specifically, for example, the reference signal in the line inversion driving is a pulsating signal in which, as shown in FIG. 3(A), an AC component of a rectangular waveform and having a period and an amplitude that are previously determined is superimposed to the DC component of a predetermined first reference voltage VDb. For example, the reference signal in the dot inversion driving is a pulsating signal in which, as shown in FIG. 3(B), an AC component of a differential waveform and having a period and an amplitude that are previously determined is superimposed to the DC component of the first predetermined reference voltage VDb. Specifically, the scanning signal is a pulse signal in which, as shown in FIG. 3(C), a pulse of a rectangular waveform and having a width that is equal to a half of the period of the reference signal is raised at a period that is an integer multiple of the period of the reference signal. When the scanning signal is applied to the TFT 15, the TFT is in the driven state during the period when the level of the signal is high, and in the suspended state during the period when the level of the signal is low.

Specifically, for example, the gradation signal is a pulsating signal in which, as shown in FIG. 3(D), an AC component of a rectangular waveform and having the same period as the reference signal is superimposed to a DC component of a predetermined second reference voltage VDs. The amplitude of the AC component of the gradation signal is varied with time in a voltage range from a value more than 0 V to a value which is not larger than a half of a predetermined maximum voltage difference Vspp of the gradation signal. In the embodiment, the reference signal, the gradation signal, and the scanning signal are synchronized with one another, and the phase of the reference signal is opposite to that of the gradation signal. Preferably, the reference signal is configured so as to assist the amplitude of the gradation signal. The signals are configured as described above.

As seen from the above description, the panel section 1 of the liquid crystal display device of the embodiment is identical in structure with the panel section 1 of the prior art and having the current structure. In the liquid crystal display device of the embodiment, the electric signals which are supplied from the driver to the panel section 1 are adjusted in order to set the leakage low-frequency electric field from the panel section 1 within the specified range of the TCO standard.

The TCO standard is a standard conforming to measurement standard MPR-II for a VDU (Visual Display Unit) which is set by SWEDAC (Swedish board for technical accreditation). In the TCO standard, as shown in Table 1 below, an upper limit reference value of a leakage low-frequency electromagnetic field in a previously defined measurement place is defined, and the range which is not larger than the upper limit reference value is set as a specified range. The frequency of a test signal is split into two frequency bands, or band I and band II. The upper limit reference value of a leakage low-frequency electromagnetic field is set as a specified range for each of the frequency bands. Band I is a frequency band of so-called ELF (Extremely Low Frequency), namely, not lower than 5 Hz and lower than 2 kHz, and band II is a frequency band of so-called VLF (Very Low Frequency), namely, not lower than 2 kHz and lower than 400 kHz. In the TCO standard, it is defined that the measurement of a leakage low-frequency electromagnetic field is performed in accordance with Swedish standard SS436 14 90 and IEEE 1140-1994, and that the measurement screen in measurement of a leakage low-frequency electromagnetic field is a screen in which a white character "H" is displayed on the whole of the screen and the background is black.

TABLE 1

| | measurement place | specified range of leakage low-frequency electric field |
|---|---|---|
| band I (ELF: 5 Hz–2 kHz) | point separated from front face by 30 cm, and that separated from periphery by 50 cm | not larger than 10 V/m |
| band II (VLF: 2 kHz–400 kHz) | point separated from front face by 30 cm, and that separated from periphery by 50 cm | not larger than 1 V/m |
| | measurement place | specified range of leakage low-frequency magnetic field |
| band I (ELF: 5 Hz–2 kHz) | point separated from front face by 30 cm, and that separated from periphery by 50 cm | not larger than 2 mG |

TABLE 1-continued

| | measurement place | specified range of leakage low-frequency electric field |
|---|---|---|
| band II (VLF: 2 kHz–400 kHz) | point separated from front face by 30 cm, and that separated from periphery by 50 cm | not larger than 0.25 mG |

As described in the paragraph of the prior art, the inventor of the present invention expects that a leakage low-frequency electric field in liquid crystal display devices of the current structure and the counter source structure in which a countermeasure for reducing a leakage low-frequency electromagnetic field is not taken (hereinafter, such a liquid crystal display device is often referred to as "untreated LCD") has the following general features. It is expected that a leakage low-frequency electric field in such a liquid crystal display device is caused mainly by a signal supplied to a component which is nearer to the display face of the device, among components of the device to which an electric signal is supplied. In the case where the amplitude waveform of the AC component of a signal supplied to a component that is remoter from the display face, among components of the device to which an electric signal is supplied is opposite in phase to that of the AC component of a signal supplied to another component that is nearer to the display face, it is expected that an effect of canceling the signals occurs to weaken the leakage low-frequency electric field of the liquid crystal display device. In this case, it is expected that the effect of weakening the leakage low-frequency electric field is further enhanced as the nearer component has a smaller area. Furthermore, it is expected that the leakage low-frequency electric field of the liquid crystal display device is further strengthened as the component which is nearer to the display face has a larger area, or the leakage low-frequency electric field is strengthened in proportion to the area of the component.

As a result of the above, in order to set the leakage low-frequency electric field from the panel section 1 within the specified range of the TCO standard, the signal supplied to a component that is nearer to the display face 21, among components of the device to which an electric signal is supplied is set so that the maximum voltage difference of the signal is within a predetermined allowable range. The maximum voltage difference of the signal is the difference between the maximum allowable voltage of the electric signal and the minimum allowable voltage of the electric signal. When the amplitude of the AC component of the reference signal always has a constant value irrespective of the passage of time, the maximum voltage difference is equal to twice the amplitude.

In the panel section 1 of the current structure, a component which is nearer to the display face 21 is the common electrode 24, and the electric signal supplied to the component is the reference signal. Therefore, the maximum voltage difference Vbpp of the reference signal has a value which is within the allowable range that is not larger than an upper limit voltage difference VMAX1 of the current structure which is defined by expression 1 below, and not smaller than the minimum voltage difference which is allowable as the maximum voltage difference Vbpp of the reference signal. The maximum voltage difference Vbpp of the reference signal is a value which depends on the threshold of the liquid crystal. In the following expressions, "x" is the total of surface areas of components which are nearer to the display face 21, i.e., the total of the surface area of the common electrode 24 (hereinafter, often referred to as "panel area"). The unit of "x" is a square meter [$m^2$]. In the embodiment, the area of the common electrode 24 is equal to that of the display region.

$$VMAX1=0.3578\times x^{-0.6156} \quad (1)$$

The minimum voltage difference which is allowable as the maximum voltage difference Vbpp of the reference signal is 0 V because of the following reason. When the panel section 1 is driven by the line inversion driving, the reference signal is a pulsating signal, and hence the minimum voltage difference has a value which is very close to 0 V, and, when the panel section 1 is driven by the dot inversion driving, the reference signal is a steady signal, and hence the minimum voltage difference is 0 V. Therefore, the specific allowable range of the maximum voltage difference Vbpp of the reference signal is not smaller than 0 V and not larger than the upper limit voltage difference VMAX1 as indicated by expression 2.

$$0 \leqq Vbpp \leqq VMAX1 \quad (2)$$

The upper limit voltage difference VMAX1 of the maximum voltage difference Vbpp of the reference signal in the panel section 1 of the liquid crystal display device of the first embodiment, i.e., the panel section 1 of the current structure was defined on the basis of a first experiment which will be described below. For the first experiment, actual panels of two kinds which have the current structure and are different from one other only in panel area x, and simulated panels of five kinds which are different from one other only in panel area x were prepared. The actual panels having the current structure are structured in the same manner as the panel section 1 having the current structure which has been described with reference to FIG. 1. Each of the simulated panels has a structure in which an aluminum foil is adhered to the whole of one face of a corrugated cardboard having a shape congruent with the display region of the panel section which is imitated by the simulated panel. In the embodiment, the size of each of the actual panels and the simulated panels is indicated by the length of a diagonal line of the display region of the panel. The actual panels of two kinds having the current structure have diagonal lines of 13.3 inches and 15.0 inches, respectively, and the simulated panels of five kinds have diagonal lines of 8.0 inches, 13.3 inches, 15.0 inches, 18.1 inches, and 21.0 inches, respectively.

As a test signal which is to be supplied to these panels, pulsating signals of five kinds which have different maximum voltage differences Vbpp were prepared. The test signals of five kinds correspond to the reference signal in the state where, in the panel sections of five kinds having different upper limit values of the black display voltage, the whole of the display face 21 of the panel section is blacked (hereinafter, such a state is referred to as "black display screen state"), i.e., all the pixels in the display face 21 are in the black display state. The test signals are equal to a test signal which is to be originally used in measurement of a leakage low-frequency electromagnetic field, i.e., a signal according to Swedish standard SS436 14 90 and IEEE 1140-1994, or the reference signal in the state where, in a panel section of the current structure which is to be subjected to measurement, a white "H" is displayed on the whole of the display face 21 of the panel section while the background is set to be black (hereinafter, such a state is referred to as "H-screen state"). When the reference signal in the black display screen state is used as a test signal, therefore, the experiment and results of the experiment can be dealt in the same manner as those in the case where the reference signal in the H-screen state is used as a test signal. Therefore, experiments of both the cases can be compared as they are with each other. The maximum voltage differences Vbpp of the test signals of five kinds are 5 V, 4 V, 3 V, 2 V, and 1 V, respectively. The test signals of five kinds have a frequency which is in band II of the TCO standard, or not lower than 2 kHz and not higher than 400 kHz. In the embodiment, the test signals have a frequency of about 25 kHz.

Figure 4:
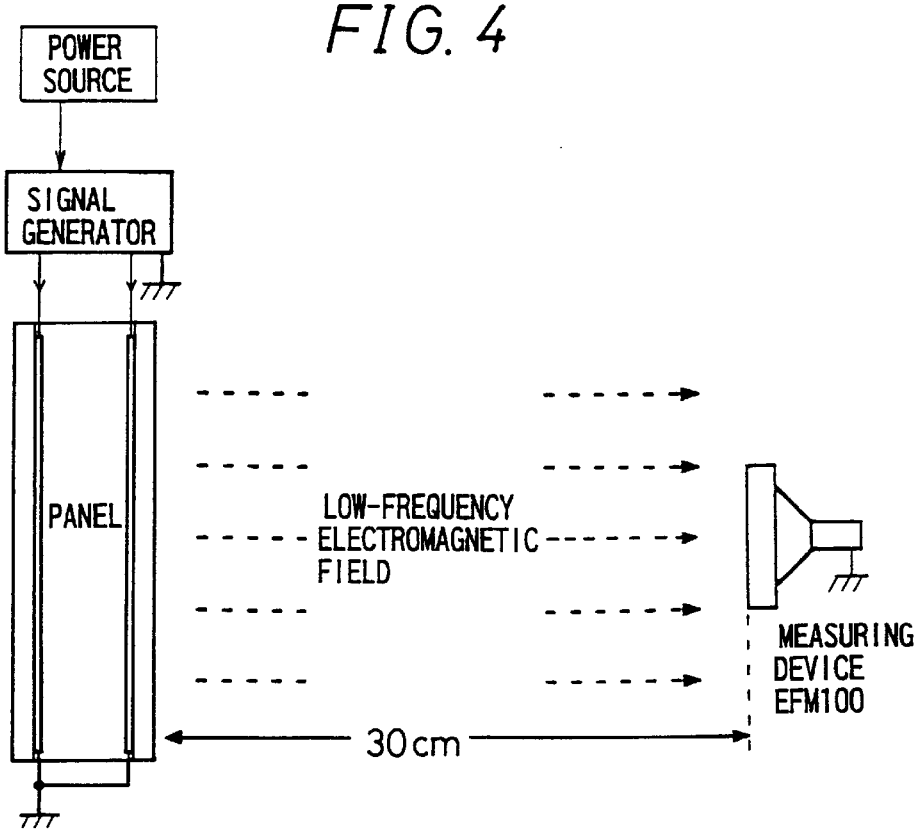
FIG. 4 is a diagram showing experiment equipment for measuring a leakage low-frequency electric field of the panel section 1.

FIG. 4 is a block diagram showing experiment equipment for measuring a leakage low-frequency electromagnetic field from the panel section 1 in the experiment of the embodiment. The measurement of a leakage low-frequency electromagnetic field was performed in accordance with the measurement method based on Swedish standard SS436 14 90 and IEEE 1140-1994. In the experiment equipment, the panel section 1 which is to be subjected to measurement is connected to a signal generator which supplies the test signals to the panel section, and grounded. A power source is connected to the signal generator. A measuring device for measuring a leakage low-frequency electric field is placed at a position which is separated by 30 cm from the display face 21 of the panel section. In the experiment of the embodiment, EFM100 (trade name) produced by TOYO Corporation is used as the measuring device.

TABLE 2

| panel size | | leakage low-frequency electric field [V/m] | |
|---|---|---|---|
| [inch] | panel area × [m$^2$] | simulated panel | actual panel |
| 15.0 | 0.0697 | 3.13 | 2.72 |
| 13.3 | 0.0548 | 2.66 | 2.53 |

(Measurement values in black display)

Table 2 shows leakage low-frequency electric fields which were measured in a state where a test signal of the maximum voltage difference Vbpp of 5 V was supplied to the actual and simulated panels of 13.3 and 15.0 inches. From the measurement results of Table 2, it will be seen that a leakage low-frequency electric field of a certain simulated panel which was measured in the state where the test signal was supplied approximates to or coincides with the leakage low-frequency electric field of the actual panel which is imitated by the simulated panel and in the state where the test signal was supplied, at a degree which may allow the results to be replaced as experiment data. In the experiment, therefore, the leakage low-frequency electric field which is the result of the measurement on the simulated panel that is configured as described above was used as the leakage low-frequency electric field of the actual panel which is imitated by the simulated panel.

TABLE 3

| | | Measurement of alternating electric field | | | | | |
|---|---|---|---|---|---|---|---|
| panel size | panel area | leakage low-frequency electric field E [V/m] | | | | | Vbpp [V] at E = 1 |
| [inch] | [m$^2$] | Vbpp = 5V | Vbpp = 4V | Vbpp = 3V | Vbpp = 2V | Vbpp = 1V | V/m |
| 21.0 | 0.1366 | 4.76 | 3.74 | 2.73 | 1.72 | 0.74 | 1.27 |
| 18.1 | 0.1015 | 3.92 | 3.07 | 2.24 | 1.42 | 0.63 | 1.47 |
| 15.0 | 0.0697 | 3.13 | 2.45 | 1.79 | 1.14 | 0.50 | 1.78 |
| 13.3 | 0.0548 | 2.66 | 2.10 | 0.53 | 0.97 | 0.43 | 2.04 |
| 8.0 | 0.0198 | 1.22 | 0.97 | 0.70 | 0.46 | 0.22 | 4.14 |

Figure 5:
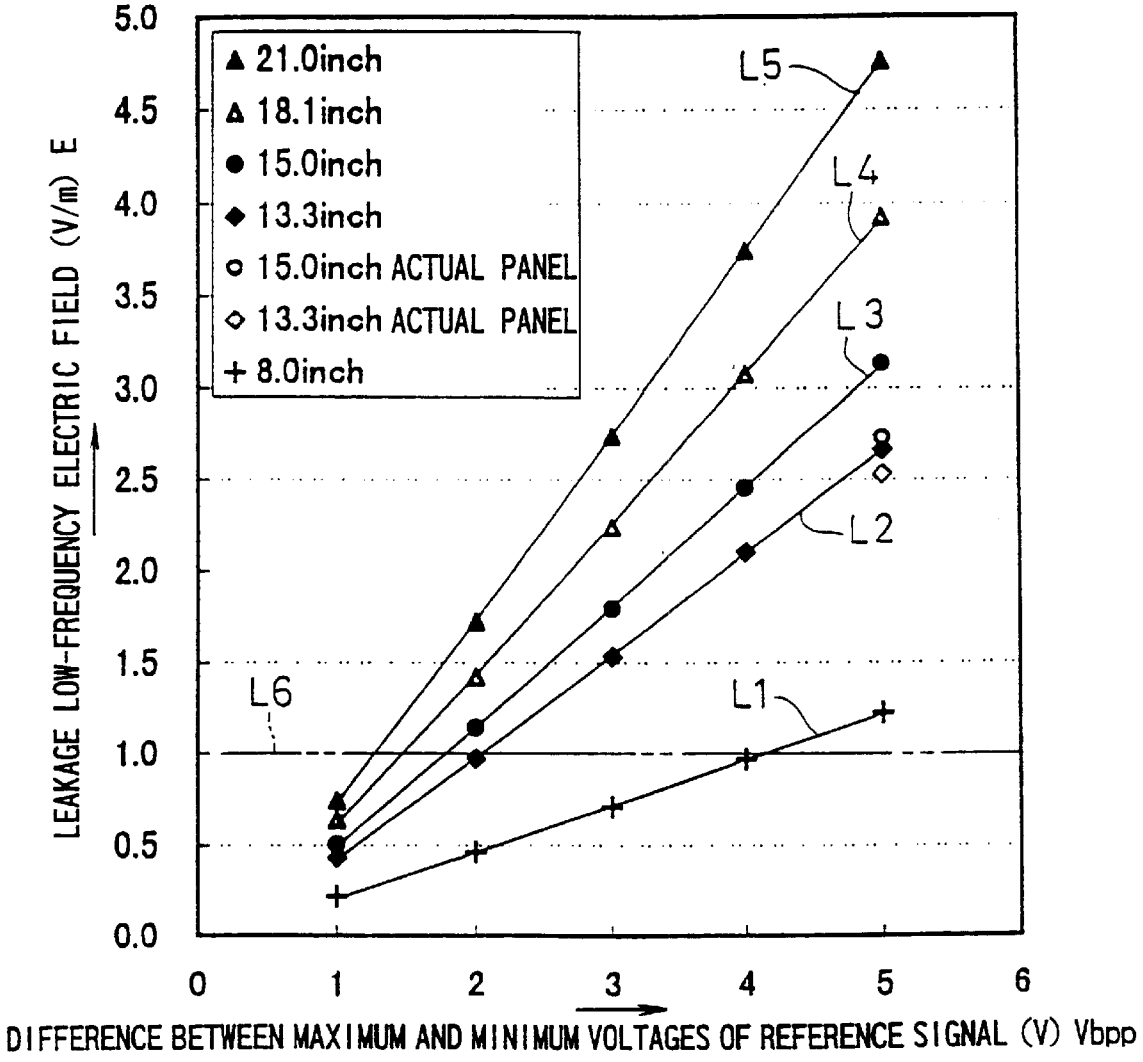
FIG. 5 is a graph showing relationships between a maximum voltage difference Vbpp of the reference signal and the leakage low-frequency electric field in the panel section 1 of the liquid crystal display device of the first embodiment.

Table 3 shows measurement results of leakage low-frequency electric fields that were measured from the actual panels which are imitated by the above-mentioned simulated panels of five kinds. Actually, the leakage low-frequency electric fields from the actual panels of five kinds are measurement results which were obtained by measuring leakage low-frequency electric fields from the simulated panels of the five kinds in the state where the test signals of five kinds were supplied to the aluminum foils of the simulated panels, respectively. FIG. 5 is a graph showing relationships between the leakage low-frequency electric fields E of the actual panels of five kinds and the maximum voltage difference Vbpp of the test signal. In FIG. 5, the five approximate curves L1 to L5 correspond to curves which indicate the leakage low-frequency electric fields E of the actual panels of 8.0 inches, 13.3 inches, 15.0 inches, 18.1 inches, and 21.0 inches with respect to the maximum voltage differences Vbpp of the test signals, respectively. The approximate curves L1 to L5 of the actual panels were obtained by the method of least squares using the measured leakage low-frequency electric fields of the actual panels and the maximum voltage differences Vbpp of the test signals which are listed in Table 3, as parameters. The approximate curves L1 to L5 of FIG. 5 are defined by following expressions 3 to 7:

$$L1{:}E=0.2518\times Vbpp-0.0423 \quad (3)$$

$$L2{:}E=0.559\times Vbpp-0.139 \quad (4)$$

$$L3{:}E=0.657\times Vbpp-0.169 \quad (5)$$

$$L4{:}E=0.823\times Vbpp-0.213 \quad (6)$$

$$L5{:}E=1.006\times Vbpp-0.28 \quad (7)$$

wherein "E" is the leakage low-frequency electric field in the unit of [V/m], and "Vbpp" is the maximum voltage difference of the test signal in the unit of [V].

Figure 6:
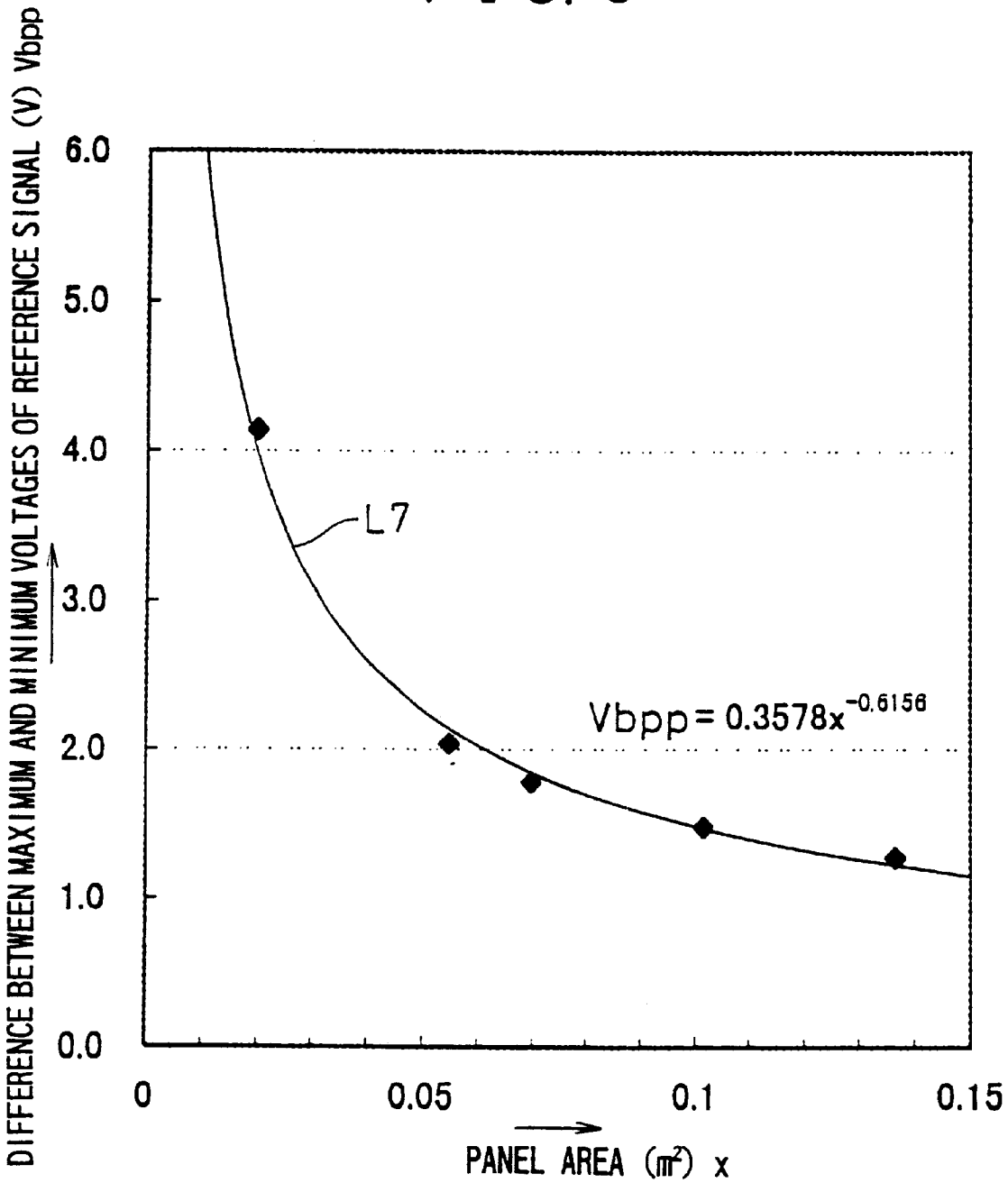
FIG. 6 is a graph showing relationships between a panel area x and a maximum voltage difference Vbpp of the reference signal in the panel section 1 of the liquid crystal display device of the first embodiment.

The right end column of Table 3 shows the maximum voltage differences Vbpp in the cases where the leakage low-frequency electric fields E of the simulated panels of five kinds which were estimated from the measurement results are 1 V/m (hereinafter, such a voltage difference is often referred to "boundary voltage difference"). The boundary voltage differences of the simulated panels correspond to leakage low-frequency electric fields on the approximate curves L1 to L5 of the simulated panels of FIG. 5, and at intersections of the approximate curves L1 to L5 and a reference line L6 indicating the reference value of the leakage low-frequency electric field of band II of the TCO standard, i.e., 1.0 V/m. The boundary voltage differences were obtained on the basis of the graph of FIG. 5. FIG. 6 is a graph showing correspondence relationships between the panel areas of the actual panels of five kinds and the boundary maximum voltage differences Vbpp of the actual panels of five kinds. The approximate curve L7 in FIG. 6 corresponds to a curve which indicates a change of the boundary voltage difference with respect to a change of the panel area x. The approximate curve L7 of FIG. 6 was obtained by the method of least squares using the panel areas x of the actual panels, and the boundary voltage differences of the actual panels and, as parameters. As a result, the approximate curve L7 of FIG. 6 is defined by following expression 8:

$$L7: Vlim = 0.3578 \times x^{-0.6156} \quad (8)$$

wherein "x" is the panel area in the unit of [$m^2$], and "Vlim" is the boundary voltage difference in the unit of [V].

As described above, it has been proved that a leakage low-frequency electric field from the panel section 1 of the current structure is caused mainly by the electric signal supplied to the common electrode 24, and the leakage low-frequency electric field is stronger as the area of the common electrode 24 is larger. From FIG. 5, it will be seen that, as the maximum voltage difference Vbpp of the reference signal supplied to the common electrode 24 of the panel section 1 is smaller, the leakage low-frequency electric field E of the panel section is lower. When the panel section 1 has the current structure and the panel area x of the panel section 1 is once determined, therefore, the maximum voltage difference Vbpp of the reference signal in the case where the leakage low-frequency electric field of the panel section 1 coincides with the upper limit reference value of band II of the TCO standard is defined by the panel area x and expression 8. As a result, when the maximum voltage difference Vbpp of the reference signal is not larger than the maximum voltage difference Vbpp specified in the above-mentioned case, the leakage low-frequency electric field from the panel section 1 is surely suppressed to the upper limit reference value of band II of the TCO standard or less. Therefore, the upper limit voltage difference VMAX1 of the maximum voltage difference Vbpp of the reference signal is defined by expression 1. In this way, the first experiment was performed.

As described above, when the maximum voltage difference Vbpp of the reference signal has a value within the allowable range defined by expressions 1 and 2, a leakage low-frequency electric field from the panel section 1 according to the invention having the current structure can be surely set to be within the specified range of the TCO standard. Furthermore, the panel section 1 of the embodiment is identical in structure with the panel section of the prior art and having the current structure. As a result, in the liquid crystal display device of the embodiment, the leakage low-frequency electric field from the panel section 1 can be surely suppressed to a value within the specified range of the TCO standard, only by adjusting the maximum voltage difference Vbpp of the reference signal and without changing the structure of the panel section 1. The upper limit voltage difference VMAX1 of the maximum voltage difference of the reference signal is defined by using the panel area x as a parameter. In the liquid crystal display device, therefore, the leakage low-frequency electric field can be always reduced to the upper limit reference value of the TCO standard or less, irrespective of the size of the panel section 1 in the device, and the area of the common electrode in the device.

Since the panel section 1 is identical in structure with the panel section of the prior art and having the current structure, the structure and production steps of the panel section 1 are not required to be changed in order to suppress a leakage low-frequency electric field, from those of the panel section of the prior art. As a result, in the liquid crystal display device of the embodiment, the leakage low-frequency electric field from the panel section 1 can be suppressed very easily. The structure and production steps of the panel section 1 are not modified as a result of provision of a countermeasure for suppressing the leakage low-frequency electric field. Therefore, an increase of the production cost of the panel section, reduction of the transmittance of the panel section 1, and impairment of the production yield of the panel section 1 which may be caused by the countermeasure for suppressing the leakage low-frequency electric field can be prevented from occurring.

Preferably, the driver of the liquid crystal display device of the embodiment drives the panel section 1 by the line inversion driving because of the following reason. Usually, the configuration of a driver for the line inversion driving is simpler than that of a driver for the dot inversion driving, and the production cost of a driver for the line inversion driving is lower than that of a driver for the dot inversion driving. When the panel section 1 is driven on the basis of the line inversion driving, therefore, the production cost of the liquid crystal display device is lower than that of a liquid crystal display device in which the dot inversion driving is used. Consequently, it is preferable to use the line inversion driving.

Figure 7:
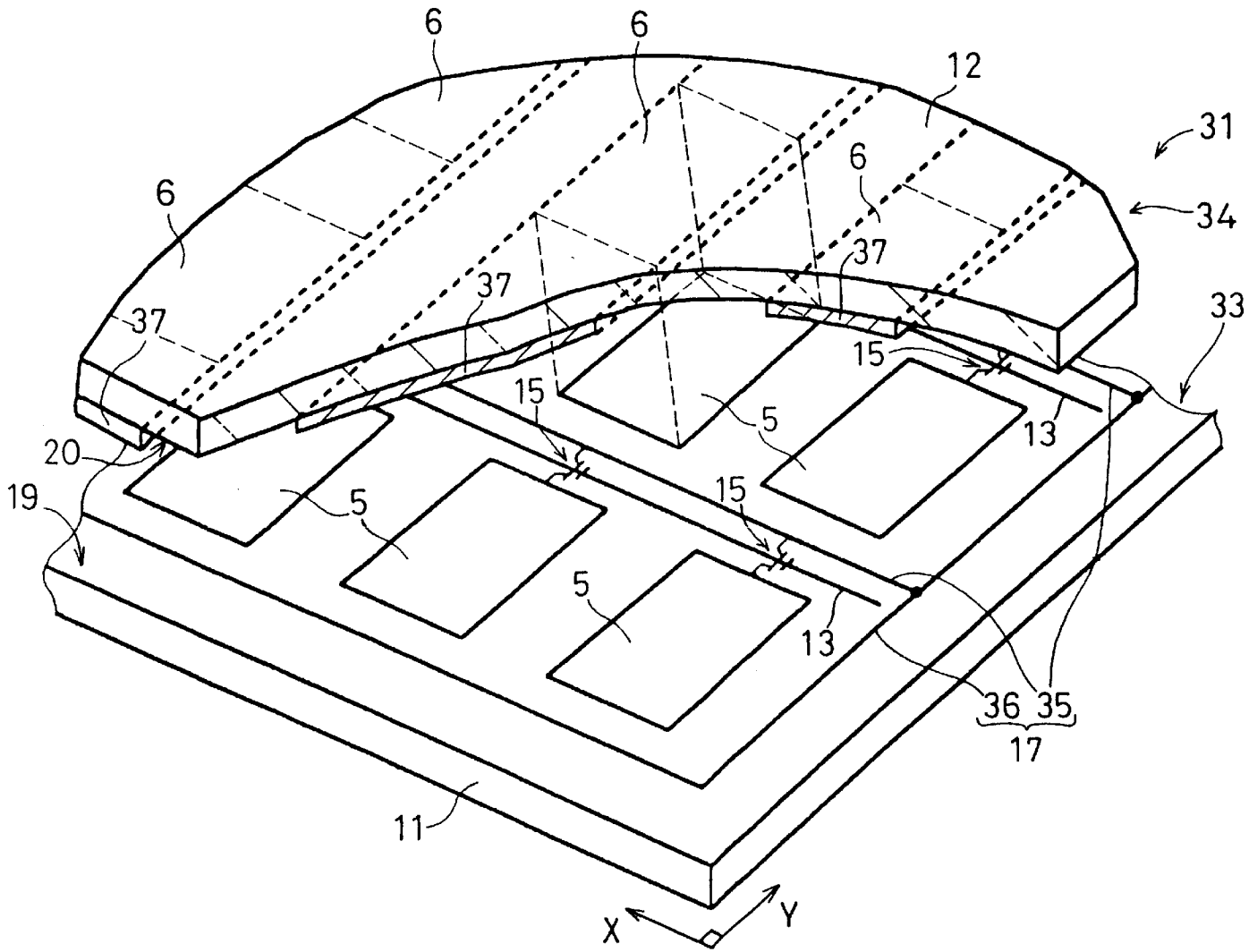
FIG. 7 is a partial enlarged perspective view schematically showing the configuration of a panel section 31 of a liquid crystal display device which is a second embodiment of the invention.

FIG. 7 is a perspective view schematically showing the configuration of a panel section 31 of a liquid crystal display device which is a second embodiment of the invention. The liquid crystal display device of the second embodiment (hereinafter, often referred to as "second liquid crystal display device") is configured in the same manner as the liquid crystal display device of the first embodiment (hereinafter, often referred to as "first liquid crystal display device") except the points which will be described later. Among components of the second liquid crystal display device, those which are identical with those of the first liquid crystal display device are designated by the same reference numerals as those of the first liquid crystal display device, and their detailed description may be omitted.

The second liquid crystal display device includes, in addition to the panel section 31, a driver for supplying an electric signal for displaying to the panel section 31. The panel section 31 basically includes pixels 3. In the embodiment, the panel section includes a plurality of pixels 3. The panel section 31 of the embodiment is a panel section of the active matrix type in which three-terminal active elements are used as switching elements, and which has the counter source structure. In the embodiment, TFTs are used as the three-terminal active elements.

Schematically speaking, the panel section 31 is divided into a main substrate section 33, an counter substrate section 34, and a liquid crystal section. The main substrate section 33 includes: scanning signal lines 13; a main substrate 11; pixel electrodes 5 of all the pixels 3; TFTs 15 the number of which is equal to the total number of the pixel electrodes 5; reference signal lines 17; and one orientation film. The counter substrate section 34 includes: counter electrodes 6 of all the pixels 3; gradation signal lines 14; an counter substrate 12; and one orientation film. In the embodiment, the panel section includes a plurality of scanning signal lines 13, a plurality of gradation signal lines 14, and one reference signal line 17. The liquid crystal section has a flat plate-like shape in which the liquid crystal layers of all the pixels 3 are integrated with one another, and is disposed between the main substrate section 33 and the counter substrate section 34. In FIG. 7, a part of the counter substrate section 34 is cut away, and the liquid crystal section and the orientation films of the substrate sections 33 and 34 are not shown. The panel section 31 is used in such a manner that the side of the counter substrate section 34 opposite to the face which is directed to the liquid crystal layer, i.e., the other face of the counter substrate 12 serves as a display face 21.

All of the scanning signal lines 13, the pixel electrodes 5, the TFTs 15, and the reference signal lines 17 are arranged on the one face 19 of the main substrate 11 in the following manner. The scanning signal lines 13, the pixel electrodes 5, and the TFTs 15 are arranged in the same manner as those of the first embodiment. The reference signal line 17 includes first portions 35 the number of which is equal to that of rows of the pixel electrodes 5 and which are linear, and second portions 36 through which the linear first portions are connected to one another. Each of the first portions 35 elongates in parallel and adjacent to corresponding one of the scanning signal lines 13. The drain terminal of each of the TFTs 15 is connected to one of the pixel electrodes 5 which is in the vicinity of the TFT, the gate terminal of the TFT 15 is connected to one of the scanning signal line 13 in the vicinity of the pixel electrode 5, and the source terminal of the TFT 15 is connected to the reference signal line 17.

The counter electrodes 6 and the gradation signal lines 14 are arranged on one face 20 of the counter substrate 12 in the following manner. The counter electrodes 6 are arranged in a matrix form in the same manner as those of the first embodiment. Each of the gradation signal lines 14 elongates in parallel and adjacent to corresponding one of the columns of the counter electrodes 6. Each of the gradation signal lines 14 is electrically connected to all the counter electrodes 6 in the column adjacent to the signal line. The gradation signal lines 14 are disposed in a relation of skew position with respect to the scanning signal lines 13 and the reference signal line 17, respectively.

In the embodiment, each of the gradation signal lines 14, and the counter electrodes 6 connected to the gradation signal line 14 are integrated to one another so as to form column electrodes 37 which are equal in number to the gradation signal lines 14. Each of the column electrodes 37 is configured by a strip-like thin film piece of an electrically conductive material. As a result, on the one face 20 of the counter substrate 12, actually, all the column electrodes 37 are arranged in such a manner that their longitudinal direction is parallel to that of the gradation signal lines 14, and gaps are formed therebetween. In each of the column electrodes 37, each of parts respectively opposed to the pixel electrodes 5 corresponds to the counter electrode 6 of a pixel including the corresponding pixel electrode 5. The part of the column electrode 37 is often referred to as "counter electrode 6." The column electrodes 37 are disposed in a relation of skew position with respect to the scanning signal lines 13 and the reference signal line 17, respectively.

The orientation films of the main substrate section 33 and the counter substrate section 34 are identical with those of the main substrate section and the counter substrate section of the first embodiment. In the case where the liquid crystal section is formed by a nematic liquid crystal and the panel section 31 is of the TN type or STN type, the panel section 31 further includes two polarizing plates. The two polarizing plates are placed in the same manner as those of the first embodiment. In the case where the liquid crystal display device can display a color image, a color filter is disposed on the main substrate 11 or the counter substrate 12. The main substrate section 33 may further include addition capacitor portions 18 the number of which is equal to that of the pixels 3. The optical properties of the main substrate 11, the counter substrate 12, the pixel electrodes 5, the counter electrodes 6, three kinds of signal lines 13, 14, and 17, the TFTs 15, and the two orientation films are identical with those of the first embodiment. When the counter electrodes 6 and the gradation signal lines 14 are integrated to one another, the column electrodes 37 are optically transparent in both the cases where the panel section 31 is of the reflection type, and where the panel section is of the transmission type. In the case where the panel section 31 is of the transmission type or the reflection type, the light source and the reflector plate are placed in the same manner as those of the first embodiment. The panel section 31 of the counter source structure is configured as described above.

The operation of the driver in the liquid crystal display device of the embodiment will be briefly described. The driver supplies the scanning signal for driving the TFTs 15, to the TFTs 15 via the scanning signal lines 13. As a result, each of the TFTs 15 is in the driven state during only a period which is defined by the scanning signal. Schematically speaking, the scanning signal is a pulsating signal, and the variation pattern in voltage of the signal is previously determined. The driver always supplies a predetermined reference signal to the reference signal line 17. When the driver performs the line inversion driving, the reference signal is a pulsating signal, and the variation pattern in voltage of the signal is previously determined. In the case where the driver performs the dot inversion driving, the reference signal is a steady signal. As a result, during a period when an arbitrary one of the TFTs 15 is in the driven state, the reference signal is supplied to the pixel electrode 5 connected to the TFT.

During the period when the arbitrary TFT 15 is in the driven state, the driver supplies to the column electrode 37 opposed to the pixel electrode 5 connected to the TFT, a gradation signal for defining the display state of the pixel. The gradation signal is a pulsating signal, and the variation pattern in voltage of the signal is set in accordance with the display state of the pixel. As a result, the voltage between the pixel electrode 5 connected to the arbitrary TFT 15 and the column electrode 37 opposed to the pixel electrode 5 is defined to a level corresponding to the display state which is to be realized by the pixel 3 including the pixel electrode 5. After the setting, the display voltage is maintained during the period when the TFT 15 connected to the pixel electrode 5 is in the suspended state. As a result of the above, the state of the liquid crystal between the pixel electrode 5 and the counter electrode 6 in the column electrode 37 is determined in accordance with the voltage between the electrodes 5 and 6. The operation of the driver has been briefly described.

Figure 8:
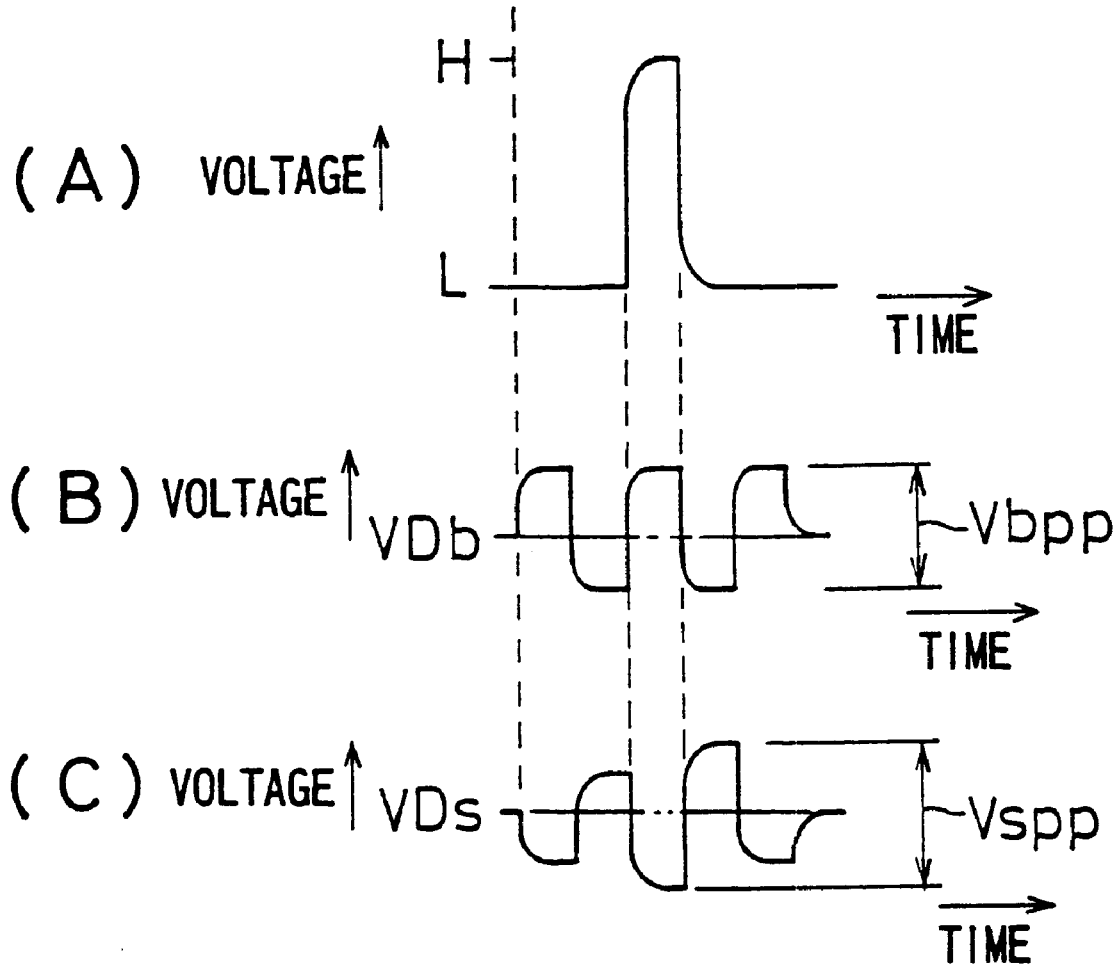
FIGS. 8(A) to 8(C) are waveform charts of a reference signal, a scanning signal, and a gradation signal in the liquid crystal display device of the second embodiment.

FIGS. 8(A) to 8(C) are waveform charts of the three kinds of signals which are supplied to the panel section 1. The scanning signal shown in FIG. 8(A) is identical with that of the first embodiment shown in FIG. 3(C). The reference signal in the line inversion driving and shown in FIG. 8(B) is identical with that of the first embodiment shown in FIG. 3(A) except that the maximum voltage difference Vbpp may have a value which is within or outside the allowable range that has been described in the first embodiment. The gradation signal shown in FIG. 8(C) is identical with that of the first embodiment shown in FIG. 3(D) except that the maximum voltage difference Vspp has a value which is within an allowable range described later. Preferably, the phase of the reference signal is opposite to that of the gradation signal.

As described in the first embodiment, it has been proved that a leakage low-frequency electric field is caused mainly by a signal supplied to a component which is nearer to the display face 21, among components of the panel section 31 to which an electric signal is supplied, and the leakage low-frequency electric field is stronger as the area of the component is larger. In the liquid crystal display device of the second embodiment, the component which is nearer to the display face 21 corresponds to the column electrodes 37, and the electric signal supplied to the component is the gradation signal. In order to set the leakage low-frequency electric field from the panel section 31 within the allowable range of the TCO standard, therefore, the maximum voltage difference Vspp of the gradation signal is set to a value within the allowable range which is not larger than an upper limit voltage difference VMAX2 of the counter source structure that is defined by expressions 9 to 11 below, and not smaller than the minimum voltage difference which is allowable as the maximum voltage difference Vspp of the gradation signal.

$$VMAX2=a\times x^{-b} \quad (9)$$

$$VMAX\mathbf{2}=a\times x^{-b} \quad (9)$$

$$a=0.3565\times y^{-0.6829} \quad (10)$$

$$b=-0.0937y+0.7091 \quad (11)$$

The maximum voltage difference Vspp of the gradation signal is the difference between the maximum voltage which the gradation signal can have, and the minimum voltage which the gradation signal can have. In expressions 9 to 11, "x" is the panel area, i.e., the area of the display region of the panel section 31, and its unit is a square meter [$m^2$]. In expressions 9 to 11, "y" is a ratio of the area of a part in the display region, in the component which is nearer to the display face 21, with respect to the panel area x. Hereinafter, the ratio y is referred to as "gradation electrode ratio." For example, the minimum voltage difference has a value which is very close to 0 V. In this case, as shown in expression 12, the maximum voltage difference Vspp is larger than 0 V and not larger than the upper limit voltage difference VMAX2.

$$0<Vspp\leqq VMAX\mathbf{2} \quad (12)$$

In the embodiment, the counter electrodes 6 and the gradation signal lines 14 are integrated to one another. Therefore, the area of the component which is nearer to the display face 21 is equal to the total area of the column electrodes 34. In the situation where the counter electrodes 6 and the gradation signal lines 14 are not integrated with one another, the area of the component contains at least the total area of the counter electrodes 6. In this situation, when the area of the gradation signal lines 14 is so large that it affects the leakage low-frequency electric field, it is preferable to set the total of the areas of all the counter electrodes 6 and all the gradation signal lines 14, as the area of the component. In the case where, under the above-mentioned situation, another component to which the gradation signal is supplied exists on the counter substrate 12 and the area of the component is so large that it affects the leakage low-frequency electric field, it is preferable to set a sum of the above-mentioned area total and the area of the component, as the area of the component.

The upper limit voltage difference VMAX2 of the maximum voltage difference Vspp of the gradation signal in the liquid crystal display device of the second embodiment was defined on the basis of a second experiment which will be described below. For the second experiment, actual panels of five kinds of the current structure which have been described in the first embodiment (hereinafter, such a panel is often referred to as "first actual panel"), simulated panels for the actual panels, and actual panels of two kinds of the counter source structure which are different from each other only in panel area x (hereinafter, such a panel is often referred to as "second actual panel") were prepared. It is assumed that the second actual panels are structured in the same manner as the panel section 31 having the counter source structure which has been described with reference to FIG. 7, and the gradation electrode ratio of the second actual panels is 0.7. The second actual panels of two kinds have diagonal lines of 13.3 inches and 15.0 inches, respectively.

As a signal which is to be supplied to these panels, the pulsating signals of five kinds which have been described in the first embodiment (hereinafter, such a signal is often referred to as "first test signal), and second test signals of two kinds were prepared. The second test signals of two kinds correspond to, for example, the gradation signal in the black display screen state in panel sections of the counter source structure of two kinds in which the liquid crystals have different dynamic ranges. The maximum voltage differences Vspp of the second test signals of two kinds are 5 V and 4.5 V, respectively. The second test signals of two kinds have a frequency which is in the frequency range specified as band II of the TCO standard, or not lower than 2 kHz and not higher than 400 kHz. In the embodiment, the second test signals have a frequency of about 25 kHz.

TABLE 4

| | | leakage low-frequency electric field [V/m] | |
|---|---|---|---|
| panel size [inch] | panel area [$m^2$] | simulated panel | comparative panel |
| 15.0 | 0.0697 | 2.19 | 2.34 |
| 13.3 | 0.0548 | 1.67 | 1.57 |

Table 4 shows relationships between leakage low-frequency electric fields which were measured in the states where a second test signal of the maximum voltage difference Vspp of 5 V, and a second test signal of the maximum voltage difference Vspp of 4.5 V were supplied to second actual panels of 15.0 inches and 13.3 inches, respectively, and leakage low-frequency electric fields of the second actual panels in such states which were estimated from the results of the measurements on the simulated panels of 15.0 inches and 13.3 inches in the experiment of the first embodiment (hereinafter, such an electric field is often referred to as estimated electric fields). An estimated electric field of a certain actual panel in the state where a certain second test signal is supplied to the panel is a product of the leakage low-frequency electric field of a simulated panel of the actual panel which is measured in the state where a first test signal of the same maximum voltage difference as that of the second test signal is supplied to the simulated panel, and the gradation electrode ratio of the actual panel which is imitated by the simulated panel. From the results of Table 4, it will be seen that the estimated electric field of the second actual panel approximates to or coincides with the leakage low-frequency electric field of the second actual panel in the state where the second test signal is actually supplied to the second actual panel, at a degree which may allow the estimated electric field to be replaced as experiment data. In the experiment, therefore, estimated electric fields of the second actual panels which are imitated by the simulated panels listed in Table 3 are obtained on the basis of the measured leakage low-frequency electric fields of the simulated panels, and the estimated electric fields are used as leakage low-frequency electric fields of the second actual panels.

The gradation signal in the black display screen state in a panel section of the counter source structure is used as a second test signal because of the following reasons. The shape of a component which is in the simulated panels used in the experiment, and to which the test signal is to be supplied is identical with that of the common electrode in a panel section of the current structure, i.e., a so-called whole-face electrode. Therefore, it is difficult to supply the gradation signal in the H-screen state, to the simulated panels. Leakage low-frequency electric fields of an actual panel of the counter source structure in the black display screen state and the H-screen state were measured. From results of the measurements, it has been proved that the leakage low-frequency electric field of the actual panel in the H-screen state is slightly weaker than that of the actual panel in the black display screen state. As a result, it will be seen that, when the leakage low-frequency electric field of the actual panel of the counter source structure in the black display screen state is within the specified range of band II of the TCO standard, the leakage low-frequency electric field of the actual panel in the H-screen state, i.e., the leakage low-frequency electric field of the actual panel which is measured in accordance with Swedish standard SS436 14 90 and IEEE 1140-1994 is always within the specified range. Because of these reasons, the second test signal was used in order to check conditions in which a leakage low-frequency electric field of a panel section of the counter source structure under situations where the leakage low-frequency electric field is strongest.

TABLE 5

| | | Measurement of alternating electric field Gradation electrode ratio: 0.7) | | | | | |
|---|---|---|---|---|---|---|---|
| panel size | panel area | leakage low-frequency electric field E [V/m] | | | | | Vspp [V] at E = 1 |
| [inch] | [$m^2$] | Vspp = 5V | Vspp = 4V | Vspp = 3V | Vspp = 2V | Vspp = 1V | V/m |
| 21.0 | 0.1366 | 3.33 | 2.62 | 1.91 | 1.20 | 0.52 | 1.70 |
| 18.1 | 0.1015 | 2.74 | 2.15 | 1.57 | 0.99 | 0.44 | 1.99 |
| 15.0 | 0.0697 | 2.19 | 1.72 | 1.25 | 0.80 | 0.35 | 2.43 |
| 13.3 | 0.0548 | 1.86 | 1.47 | 1.07 | 0.68 | 0.30 | 2.80 |
| 8.0 | 0.0198 | 0.86 | 0.68 | 0.49 | 0.32 | 0.15 | 5.84 |

Figure 9:
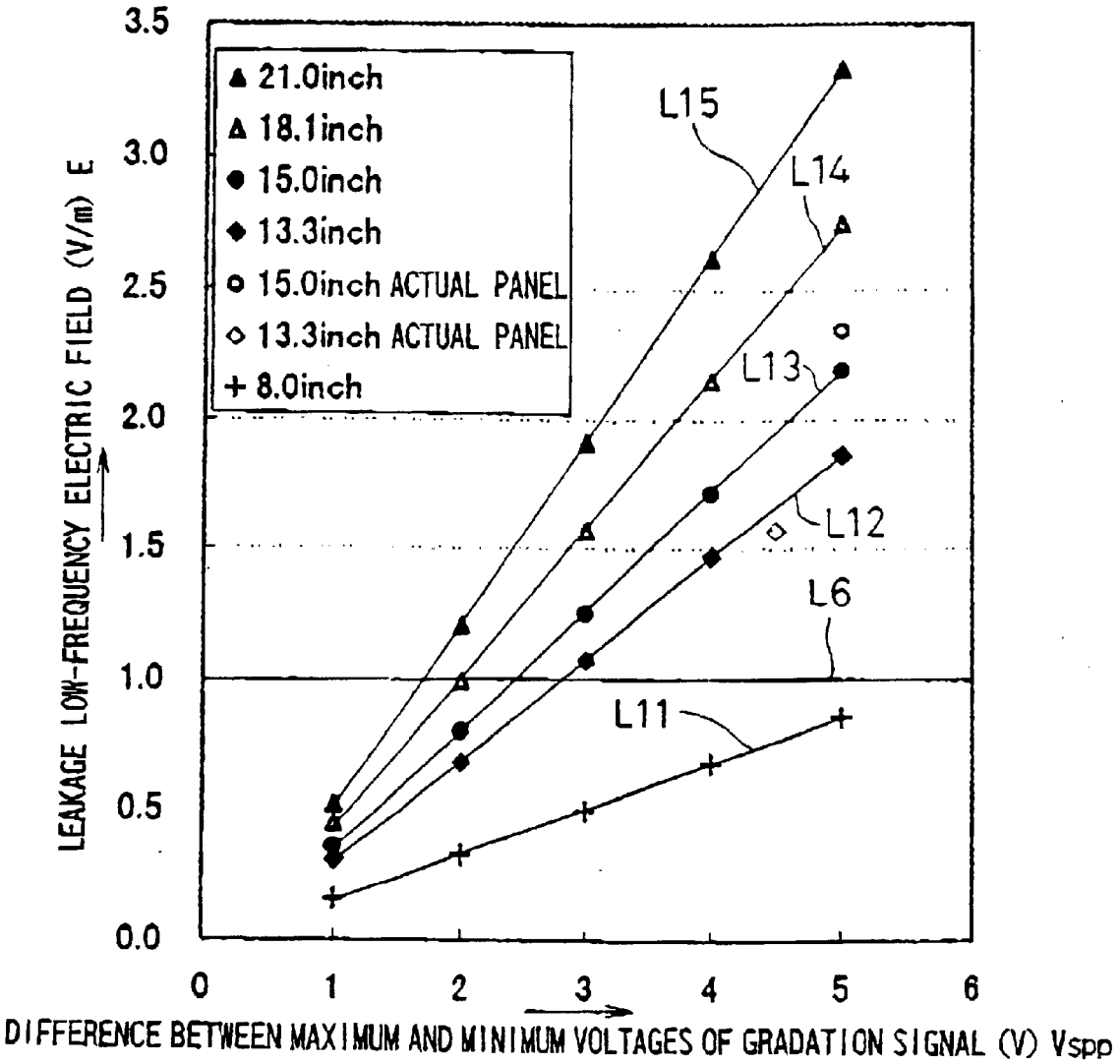
FIG. 9 is a graph showing relationships between a maximum voltage difference Vspp of the gradation signal and the leakage low-frequency electric field in the panel section 31 of the liquid crystal display device of the second embodiment in the case where a gradation electrode ratio y is 0.70.

Table 5 shows leakage low-frequency electric fields of second actual panels of five kinds which are imitated by simulated panels of five kinds, in the case where the gradation electrode ratio of each of the second actual panels is assumed to be 0.70. Actually, the leakage low-frequency electric fields of the second actual panels are products of the measurement results of the simulated panels of the second actual panels in Table 3, and the gradation electrode ratios of the second actual panels, i.e., estimated electric fields. FIG. 9 is a graph showing relationships between the estimated leakage low-frequency electric field E in the second actual panels of five kinds, and the maximum voltage difference Vspp of the second test signal. In FIG. 9, the five approximate curves L11 to L15 correspond to curves which indicate the estimated electric fields of the second actual panels of 8.0 inches, 13.3 inches, 15.0 inches, 18.1 inches, and 21.0 inches with respect to the maximum voltage differences Vspp of the second test signal, respectively. The approximate curves L11 to L15 of the second actual panels were obtained by the method of least squares using the estimated electric fields of the second actual panels and the maximum voltage difference Vspp of the second test signal which are listed in Table 5, as parameters. The approximate curves L11 to L15 of FIG. 9 are defined by following expressions 13 to 17:

$$L11{:}E=0.1763\times Vspp-0.0296 \quad (13)$$

$$L12{:}E=0.3913\times Vspp-0.0973 \quad (14)$$

$$L13{:}E=0.4599\times Vspp-0.1183 \quad (15)$$

$$L14{:}E=0.5761\times Vspp-0.1491 \quad (16)$$

$$L15{:}E=0.7042\times Vspp-0.196 \quad (17)$$

wherein "E" is the leakage low-frequency electric field in the unit of [V/m], and "Vspp" is the maximum voltage difference in the unit of [V].

Figure 10:
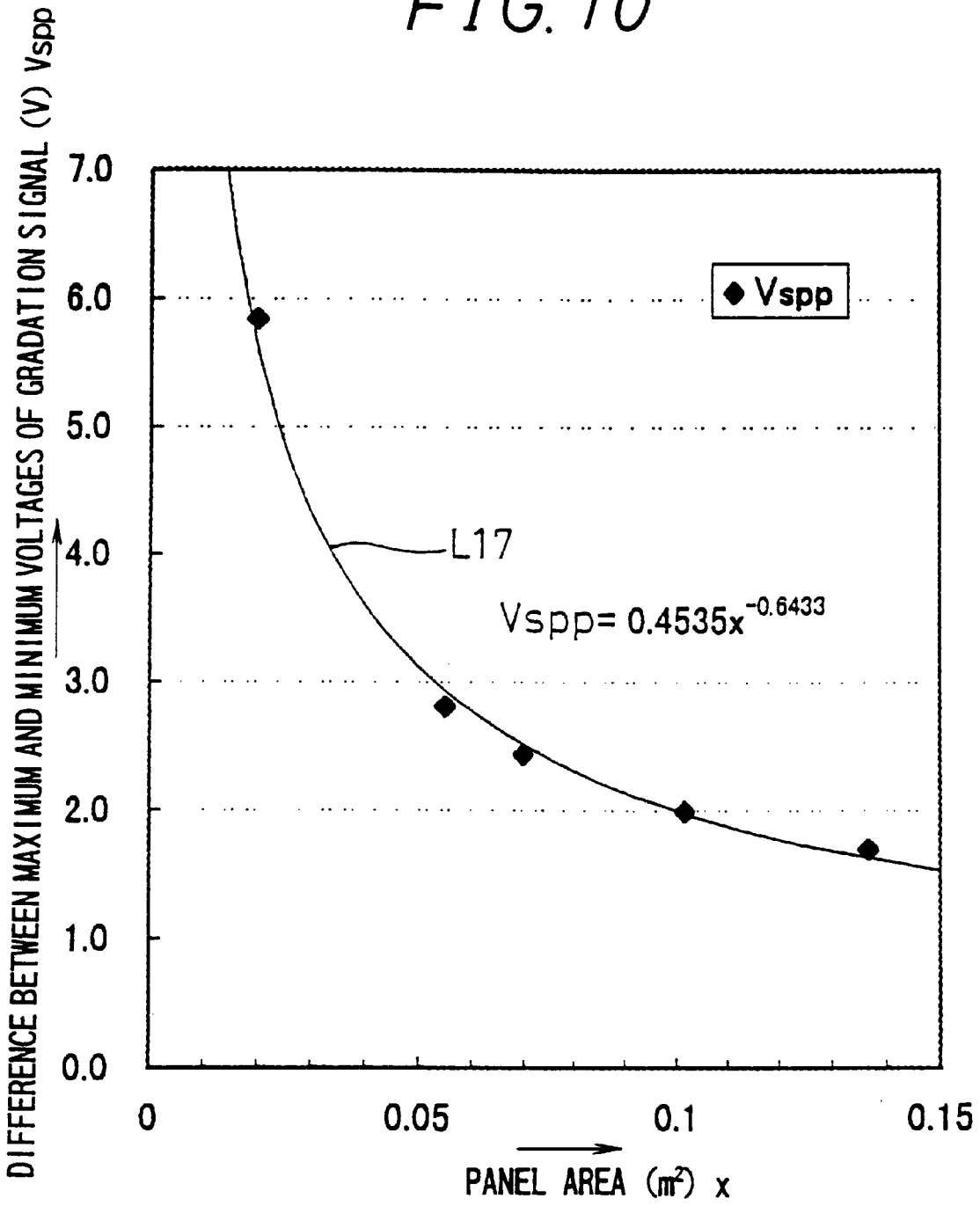
FIG. 10 is a graph showing relationships between a panel area x and a maximum voltage difference Vspp of the gradation signal in the panel section 31 of the liquid crystal display device of the second embodiment in the case where the gradation electrode ratio y is 0.70.

The right end column of Table 5 shows the maximum voltage differences Vspp in the cases where the leakage low-frequency electric fields E of the second actual panels of five kinds are 1 V/m (hereinafter, such a voltage difference is often referred to "boundary voltage difference"). The boundary voltage differences of the second actual panels correspond to leakage low-frequency electric fields on the approximate curves L11 to L15 of the second actual panels of FIG. 9, and at intersections of the approximate curves L11 to L15 and the reference line L6 indicating the reference value of the leakage low-frequency electric field of band II of the TCO standard. The boundary voltage differences were obtained on the basis of the graph of FIG. 9. FIG. 10 is a graph showing correspondence relationships between the panel areas x of the second actual panels in which the gradation electrode ratio is 0.70 and which are imitated by the simulated panels, and the boundary voltage difference of the second actual panels. The approximate curve L17 in FIG. 10 corresponds to a curve which indicates a change of the boundary maximum voltage difference Vspp with respect to a change of the panel area. The approximate curve L17 of FIG. 10 was obtained by the method of least squares using the panel areas of the second actual panels listed in Table 5 and the boundary voltage differences of the second actual panels, as parameters. The approximate curve L17 of FIG. 10 is defined by following expression 18:

$$L17: Vlim = 0.4535 \times x^{-0.6433} \quad (18)$$

wherein "x" is the panel area in the unit of [$m^2$], and "Vlim" is the boundary voltage difference in the unit of [V].

TABLE 6

| panel size [inch] | panel area [$m^2$] | Measurement of alternating electric field (Gradation electrode ratio: 0.8) leakage low-frequency electric field E [V/m] Vspp = 5V | Vspp = 4V | Vspp = 3V | Vspp = 2V | Vspp = 1V | Vspp [V] at E = 1 V/m |
|---|---|---|---|---|---|---|---|
| 21.0 | 0.1366 | 3.81 | 2.99 | 2.18 | 1.38 | 0.59 | 1.52 |
| 18.1 | 0.1015 | 3.14 | 2.46 | 1.79 | 1.14 | 0.50 | 1.78 |
| 15.0 | 0.0697 | 2.50 | 1.96 | 1.43 | 0.91 | 0.40 | 2.16 |
| 13.3 | 0.0548 | 2.13 | 1.68 | 1.22 | 0.78 | 0.34 | 2.48 |
| 8.0 | 0.0198 | 0.98 | 0.77 | 0.56 | 0.37 | 0.17 | 5.13 |

TABLE 7

| panel size [inch] | panel area [$m^2$] | Measurement of alternating electric field (Gradation electrode ratio: 0.6) leakage low-frequency electric field E [V/m] Vspp = 5V | Vspp = 4V | Vspp = 3V | Vspp = 2V | Vspp = 1V | Vspp [V] at E = 1 V/m |
|---|---|---|---|---|---|---|---|
| 21.0 | 0.1366 | 2.86 | 2.24 | 1.64 | 1.03 | 0.44 | 1.94 |
| 18.1 | 0.1015 | 2.35 | 1.84 | 1.34 | 0.85 | 0.38 | 2.28 |
| 15.0 | 0.0697 | 1.88 | 1.47 | 1.07 | 0.68 | 0.30 | 2.79 |
| 13.3 | 0.0548 | 1.60 | 1.26 | 0.92 | 0.58 | 0.26 | 3.23 |
| 8.0 | 0.0198 | 0.73 | 0.58 | 0.42 | 0.27 | 0.13 | 6.79 |

Tables 6 and 7 show leakage low-frequency electric fields of second actual panels of five kinds which are imitated by simulated panels of five kinds, in the cases where the gradation electrode ratio of each of the second actual panels is assumed to be 0.80 and 0.60. Actually, the leakage low-frequency electric fields of the second actual panels in Tables 6 and 7 are products of the measurement results of the simulated panels of the second actual panels in Table 3, and the gradation electrode ratios of the second actual panels, i.e., estimated electric fields. The right end column of each of Tables 6 and 7 shows the boundary voltage differences of the second actual panels of five kinds. In the cases where the gradation electrode ratio has the above-mentioned value, the boundary voltage differences can be calculated in the same manner as the technique which has been described with reference to Table 5.

Figure 11:
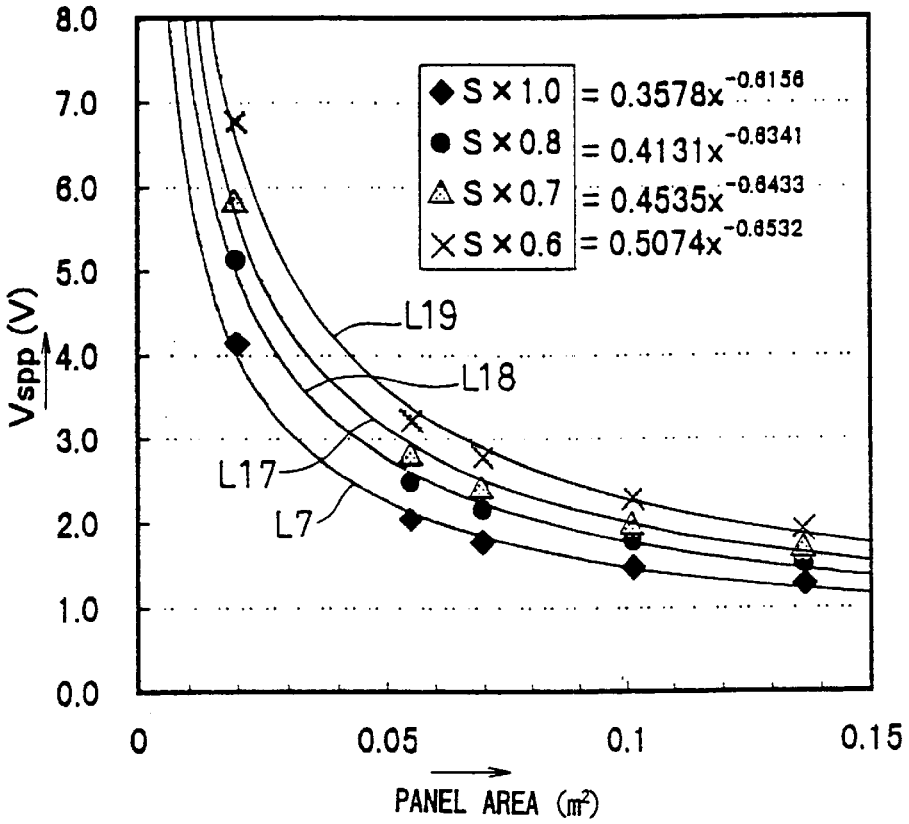
FIG. 11 is a graph showing relationships between the panel area x and the maximum voltage difference Vspp of the gradation signal in the panel section 31 of the liquid crystal display device of the second embodiment in the case where the gradation electrode ratio y is 1.00, 0.80, 0.70, and 0.60.

FIG. 11 is a graph showing correspondence relationships between the panel area x and the boundary voltage difference of the second actual panels in which the gradation electrode ratio is 1.00, 0.80, 0.70, and 0.60. The approximate curves L7 and L17 in FIG. 11 are equal to those shown in FIGS. 6 and 10. The approximate curves L18 and L19 in FIG. 11 show the correspondence relationships of the second actual panels in which the gradation electrode ratio is 0.80 and 0.60. The approximate curves L7 and L17 to L19 in FIG. 11 correspond to curves which indicate a change of the boundary voltage difference with respect to a change of the panel area, respectively. The technique of calculating the approximate curves L18 and L19 is identical with that of calculating the approximate curve L17 of FIG. 10 except that the parameters are changed to the data of Tables 6 and 7. The approximate curves L7 and L17 to L19 of FIG. 11 are defined by following expressions 8 and 18 to 20:

$$L7: Vlim = 0.3578 \times x^{-0.6156} \quad (8)$$

$$L18: Vlim = 0.4131 \times x^{-0.6341} \quad (19)$$

$$L17: Vlim = 0.4535 \times x^{-0.6433} \quad (18)$$

$$L19: Vlim = 0.5074 \times x^{-0.332} \quad (20)$$

wherein "x" is the panel area in the unit of [$m^2$], and "Vlim" is the boundary voltage difference in the unit of [V].

From Tables 5 to 7 and FIGS. 9 to 11, it will be seen that the leakage low-frequency electric field of the second actual panel, i.e., the panel section 31 of the counter source structure is defined by the panel area x, the gradation electrode ratio y, and the maximum voltage difference Vspp of the gradation signal. In other words, when the panel area x and the gradation electrode ratio y are once determined, the leakage low-frequency electric field E is strengthened in proportion to the maximum voltage difference Vspp of the gradation signal. When the gradation electrode ratio y and the maximum voltage difference Vspp of the gradation signal are once determined, the leakage low-frequency electric field E is further strengthened as the panel area x is increased. When the panel area x is once determined, the boundary voltage difference is made smaller as the gradation electrode ratio y is increased. As a result, it will be seen that correspondence relationships between the panel area x and the boundary voltage difference in a panel section of the counter source structure are changed in accordance with the gradation electrode ratio y of the panel section 31.

TABLE 8

| gradation electrode ratio | a | b |
|---|---|---|
| 0.6 | 0.507 | 0.6532 |
| 0.7 | 0.454 | 0.6433 |
| 0.8 | 0.413 | 0.6341 |
| 1.0 | 0.358 | 0.6156 |

Figure 12:
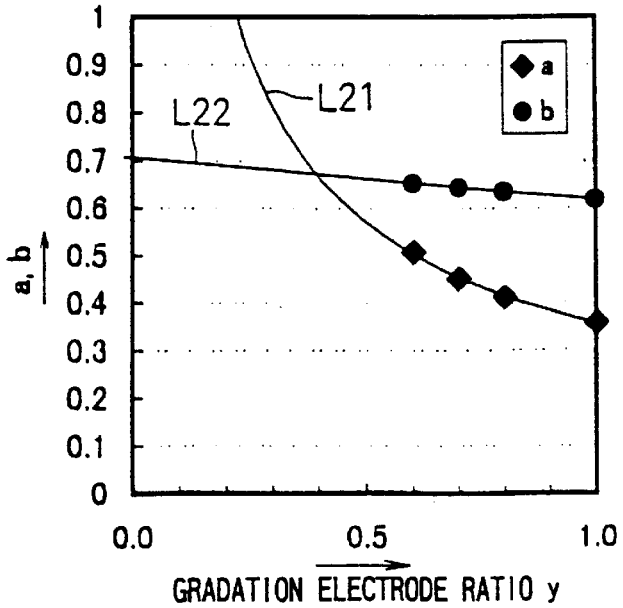
FIG. 12 is a graph showing relationships between a gradation electrode ratio, and a constant a and a multiplier b of a relational expression in the case where the relational expression between the maximum voltage difference Vspp of the gradation signal and the panel area x in a panel section of the counter source structure is $ax^{-b}$ under-situations where the leakage low-frequency electric field is equal to the reference value of the TCO standard.

Table 8 shows relationships between the gradation electrode ratio y of a panel section of the counter source structure, and a constant a and a multiplier b of an expression of a curve which indicates correspondence relationships between the boundary voltage difference and the panel area in the panel section and shown in FIG. 11, in the case where it is assumed that the expression is an exponential function indicated by expression 21. Namely, the expression of the curve corresponds to above-mentioned expressions 8, and 18 to 20. FIG. 12 is a graph showing the dependencies of the constant a and the multiplier b on the gradation electrode ratio y in the above case. In FIG. 12, the approximate curves L21 and L22 correspond to curves indicating changes of the constant a and the multiplier b of the above-mentioned expressions, with respect to a change of the gradation electrode ratio y. The approximate curves L21 and L22 of FIG. 12 were obtained by the method of least squares using the gradation electrode ratio y of the second actual panels and listed in Table 8, and the constant a and the multiplier b of the above-mentioned expressions of the second actual panels, as parameters. The approximate curves L21 and L22 of FIG. 12 are defined by following expressions 22 and 23:

$$Vlim=a\times x^{-b} \tag{21}$$

$$L21:a=0.3565\times y^{-0.6829} \tag{22}$$

$$L22:b=-0.0937y+0.7091 \tag{23}$$

As described above, it has been proved that a leakage low-frequency electric field from the panel section 31 of the counter source structure is caused mainly by the gradation signal, and the leakage low-frequency electric field is stronger as the total area of the column electrodes 37 is larger. It has been proved also that, when the panel area x and the gradation electrode ratio y are once defined, the leakage low-frequency electric field of the panel section is further reduced as the maximum voltage difference Vspp of the gradation signal is smaller. When the panel section 31 has the counter source structure and the panel area x and the gradation electrode ratio y of the panel section 31 are once determined, therefore, the maximum voltage difference Vspp in the case where the leakage low-frequency electric field of the panel section 31 coincides with the reference value of band II of the TCO standard is defined by the panel area x, the ratio y, and expressions 21 to 23. As a result, when the maximum voltage difference Vspp of the gradation signal supplied to the column electrodes 37 of the panel section 31 is not larger than the specified maximum voltage difference Vspp in the above-mentioned case, the leakage low-frequency electric field from the panel section 31 is surely suppressed to the reference value of band II of the TCO standard or less. Therefore, the upper limit voltage difference VMAX2 of the maximum voltage difference Vspp of the gradation signal is defined by expressions 9 to 12. In this way, the second experiment was performed.

As described above with reference to FIG. 7, the signal lines of two kinds placed on the one face 19 of the main substrate 11, i.e., the scanning signal lines 13 and the reference signal line 17 do not intersect with each other on the one face. In the panel section 31 of the counter source structure, therefore, the main substrate section 33 is simpler in structure than that in the panel section of the current structure. Since the substrate on which the two kinds of signal lines 13 and 17 are placed is different from that on which the gradation signal lines 14 are placed, the step of forming the two kinds of signal lines 13 and 17 is independent from that of forming the gradation signal lines 14, i.e., the column electrodes 37, and the two forming steps are not continuously conducted. As a result, the number of breakage failures of the signal lines 13, 14, and 17 is very smaller than that of the signal lines 13, 14, and 17 in a panel section of the current structure. Therefore, the production cost of the panel section 31 of the counter source structure is lower than that of a panel section of the current structure. In a panel section of the counter source structure, moreover, the reliability after production is improved.

In the panel section 31 of the counter source structure shown in FIG. 7, the total of the areas of the components to which an electric signal is supplied, and which are on one of the two substrate sections of the panel section 31 that is nearer to the display face 21 is smaller than the total of the areas of such components in the panel section 1 of the current structure shown in FIG. 1. In other words, the total of the areas of all the column electrodes 37 in the panel section 31 of the counter source structure shown in FIG. 7 is smaller than the area of the common electrode 24 of the panel section 1 of the current structure shown in FIG. 1. As described above, a leakage low-frequency electric field from a panel section is stronger as the area of a component to which an electric signal is supplied, and which is in the substrate section of the panel section that is nearer to the display face 21. Because of these reasons, the leakage low-frequency electric field of the panel section 31 of the counter source structure shown in FIG. 7 is reduced to, for example, 60% or more and 80% or less of that of the panel section 1 of the current structure shown in FIG. 1.

As described above, when the maximum voltage difference Vspp of the gradation signal has a value within the allowable range defined by expressions 9 to 12, a leakage low-frequency electric field from the panel section 31 of the embodiment having the counter source structure can be surely set to be within the specified range of the TCO standard. The panel section 31 of the embodiment is identical in structure with the panel section of the prior art and having the counter source structure. In the liquid crystal display device of the embodiment, therefore, the leakage low-frequency electric field from the panel section 31 can be surely suppressed to the reference value of a leakage low-frequency electric field specified in the TCO standard, only by adjusting the maximum voltage difference Vspp of the gradation signal and without changing the structure of the panel section 31. The upper limit voltage difference VMAX2 of the maximum voltage difference of the gradation signal is defined by using the panel area x and the gradation electrode ratio y as parameters. In the liquid crystal display device, therefore, it is always possible to easily obtain the upper limit voltage difference VMAX2, irrespective of changes of the size of the panel section 31 and the shape of the column electrodes 37. Consequently, the gradation signal can be easily adjusted.

Since the panel section 31 is identical in structure with the panel section of the prior art and having the counter source structure, the structure and production steps of the panel section 31 are not required to be changed in order to suppress a leakage low-frequency electric field, from those of the panel section of the prior art. In the liquid crystal display device of the second embodiment, the leakage low-frequency electric field from the panel section 31 can be suppressed very easily because of the same reason as those of the first liquid crystal display device. Furthermore, an increase of the production cost, reduction of the transmittance of the panel section 31, and impairment of the production yield of the panel section which may be caused by a countermeasure for suppressing the leakage low-frequency electric field can be prevented from occurring.

A liquid crystal display device which is a third embodiment of the invention (hereinafter, often referred to as "third liquid crystal display device") will be described. The third liquid crystal display device is configured in the same manner as the liquid crystal display device of the second embodiment (hereinafter, often referred to as "second liquid crystal display device") except the points which will be described later. Among components of the third liquid crystal display device, those which are identical with those of the second liquid crystal display device are designated by the same reference numerals as those of the first liquid crystal display device, and their detailed description may be omitted.

The third liquid crystal display device includes a panel section of the counter source structure, and a driver. The panel section of the third liquid crystal display device is configured in the same manner as the panel section 31 of the second liquid crystal display device except that the panel section is designed so that the dynamic range Vdyn of the liquid crystal in the panel section is within an allowable range which will be described later. The driver of the third liquid crystal display device operates in the same manner as that of the second liquid crystal display device except that the maximum voltage difference Vspp of the gradation signal is set on the basis of the above-mentioned dynamic range Vdyn of the liquid crystal.

In the panel section of the third liquid crystal display device, in order to set the leakage low-frequency electric field from the panel section within the allowable range of band II of the TCO standard, the dynamic range Vdyn of the liquid crystal is set not to be larger than an upper limit voltage difference VMAX3 of the counter source structure defined by expressions 24 to 26 below, and not to be smaller than the minimum voltage difference which is allowable as the dynamic range Vdyn. For example, the minimum voltage difference has a value which is very close to 0 V, and larger than 0 V. As indicated by expression 27, therefore, the allowable range of the dynamic range Vdyn of the liquid crystal is not larger than the upper limit voltage difference VMAX3, and larger than 0 V. Expressions 24 to 26 which define the upper limit voltage difference VMAX3 of the dynamic range Vdyn of the liquid crystal are obtained based on the same concept as that for defining the upper limit voltage difference VMAX2 of the maximum voltage difference Vspp of the gradation signal by means of expressions 9 to 11, as described in the second embodiment.

$$VMAX3 = a \times x^{-b} \tag{24}$$

$$a = 0.3565 \times y^{-0.6829} \tag{25}$$

$$b = -0.0937y + 0.7091 \tag{26}$$

$$0 < Vdyn \leqq VMAX3 \tag{27}$$

In place of the maximum voltage difference Vspp of the gradation signal, the dynamic range Vdyn of the liquid crystal of the panel section 31 is restricted as indicated by expressions 24 to 27, because of the following reason. The maximum voltage difference Vspp of the gradation signal has a value which depends on the dynamic range Vdyn of the liquid crystal. The dynamic range Vdyn of the liquid crystal is the difference between the black display voltage and the white display voltage. The black and white display voltages are display voltages of arbitrary pixels in the case where the pixels are in the black display state and the white display state. The transmittance of a pixel in the black display state is 0%, and that of a pixel in the white display state is 100%. Based on the transmittance-voltage characteristics of a pixel of the liquid crystal display device, the black voltage is selected to have a value at which the transmittance of each pixel is surely set to 0%, and the white display voltage is selected to have a value at which the transmittance of each pixel is surely set to 100%. The transmittance-voltage characteristics of a pixel are determined on the basis of the configuration of the pixel and that of the liquid crystal in the pixel.

Figure 13:
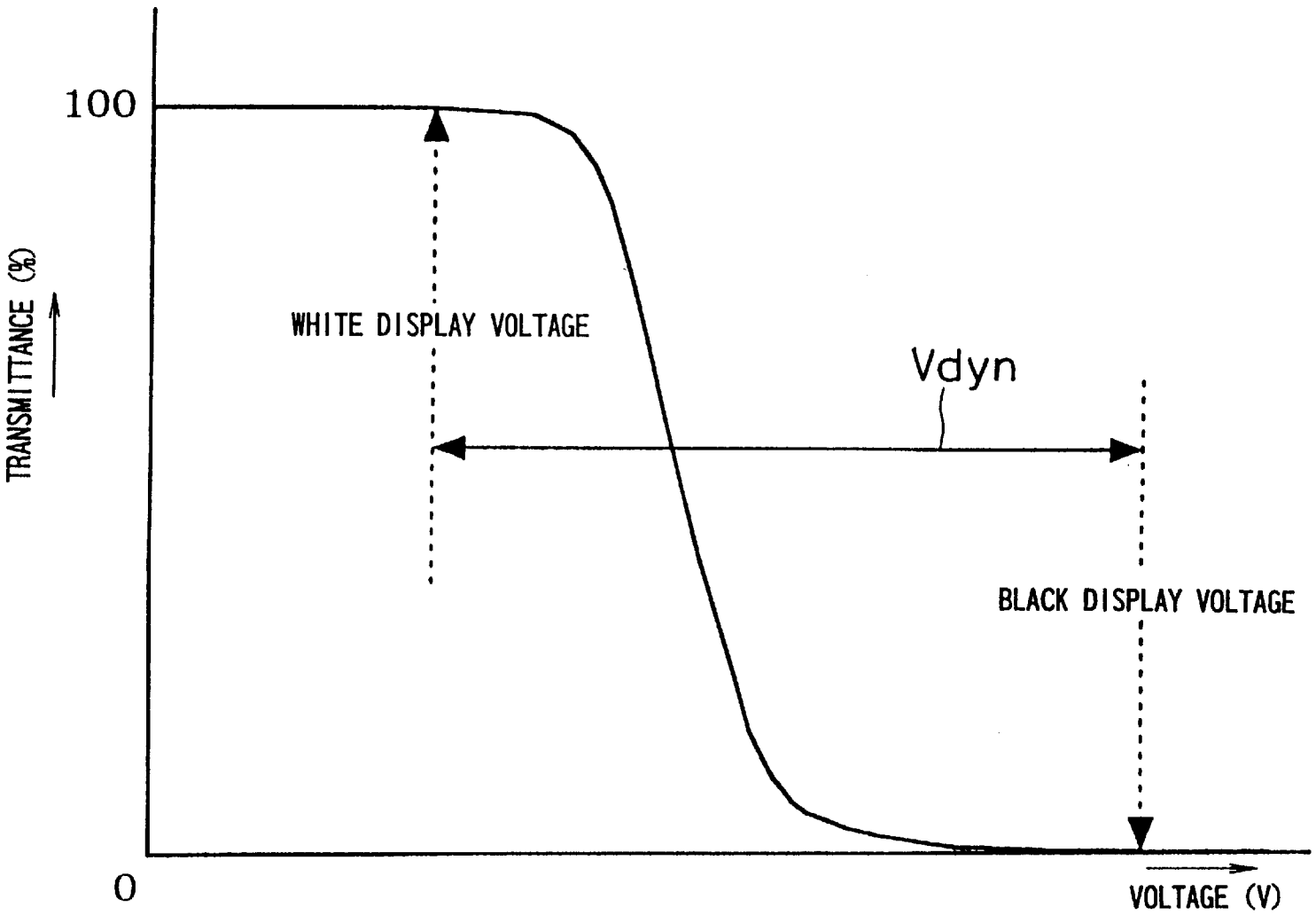
FIG. 13 is a graph of voltage-transmittance characteristics of a pixel in a panel section of a liquid crystal display device which is a third embodiment of the invention.

FIG. 13 is a graph showing the transmittance-voltage characteristics of a pixel in the panel section of the liquid crystal display device of the embodiment in the case where the device is of the so-called normally white display type. The transmittance-voltage characteristics of a pixel show relationships between the display voltage of the pixel in the panel section and the transmittance of the liquid crystal in the pixel. The display voltage of a pixel is a voltage between the pixel electrode 5 in the pixel, and the counter electrode 6 of the column electrode 37 opposed to the pixel electrode. In the above case, during a period when the display voltage of a pixel has a value within a first voltage range from 0 V to a value less than a predetermined first threshold voltage, the transmittance of the pixel is about 100% irrespective of the display voltage. In the above case, in a second voltage range from the first threshold voltage to a value less than a predetermined second threshold voltage, the transmittance of the pixel is reduced as the display voltage of the pixel is higher. In the above case, when the display voltage of a pixel is in a third voltage range which is not lower than the second threshold voltage, the transmittance of the pixel is about 0% irrespective of the display voltage.

In the above case, therefore, the black voltage is set to a value in the third voltage range, and the white display voltage is set to a value in the first voltage range. As a result, in the case where the liquid crystal display device is of the normally white display type, the black voltage is higher than the white display voltage. The difference between the black and white display voltages which are set as described above is used as the dynamic range of the liquid crystal. In the case where the liquid crystal display device is of the so-called normally black display type, the dynamic range Vdyn of the liquid crystal is determined on the basis of the transmittance-voltage characteristics of a pixel in the panel section in the case where the device is of the normally black display type, based on the same concept as that for the case where the device is of the normally white display type.

The display voltage of an arbitrary one of the pixels 3 is equal to the difference between the voltage of the gradation signal and that of the reference signal. When the reference signal is previously determined, therefore, the voltage of the gradation signal at an arbitrary timing is set on the basis of the transmittance which the arbitrary pixel 3 is to have at the timing, the voltage of the reference signal at the timing, and the dynamic range of the liquid crystal, so that the difference between the voltage of the gradation signal at the timing and that of the reference signal at the timing is equal to the display voltage which is defined by the transmittance and the dynamic range of the liquid crystal. Therefore, the maximum voltage difference Vspp of the gradation signal is smaller as the dynamic range Vdyn of the liquid crystal is smaller. When the dynamic range of the liquid crystal is within the allowable range defined by expressions 24 to 27 above, consequently, also the maximum voltage difference Vspp of the gradation signal is within the allowable range. As a result, it is preferable to set the dynamic range of the liquid crystal so as to be within the above-mentioned range.

Figure 14:
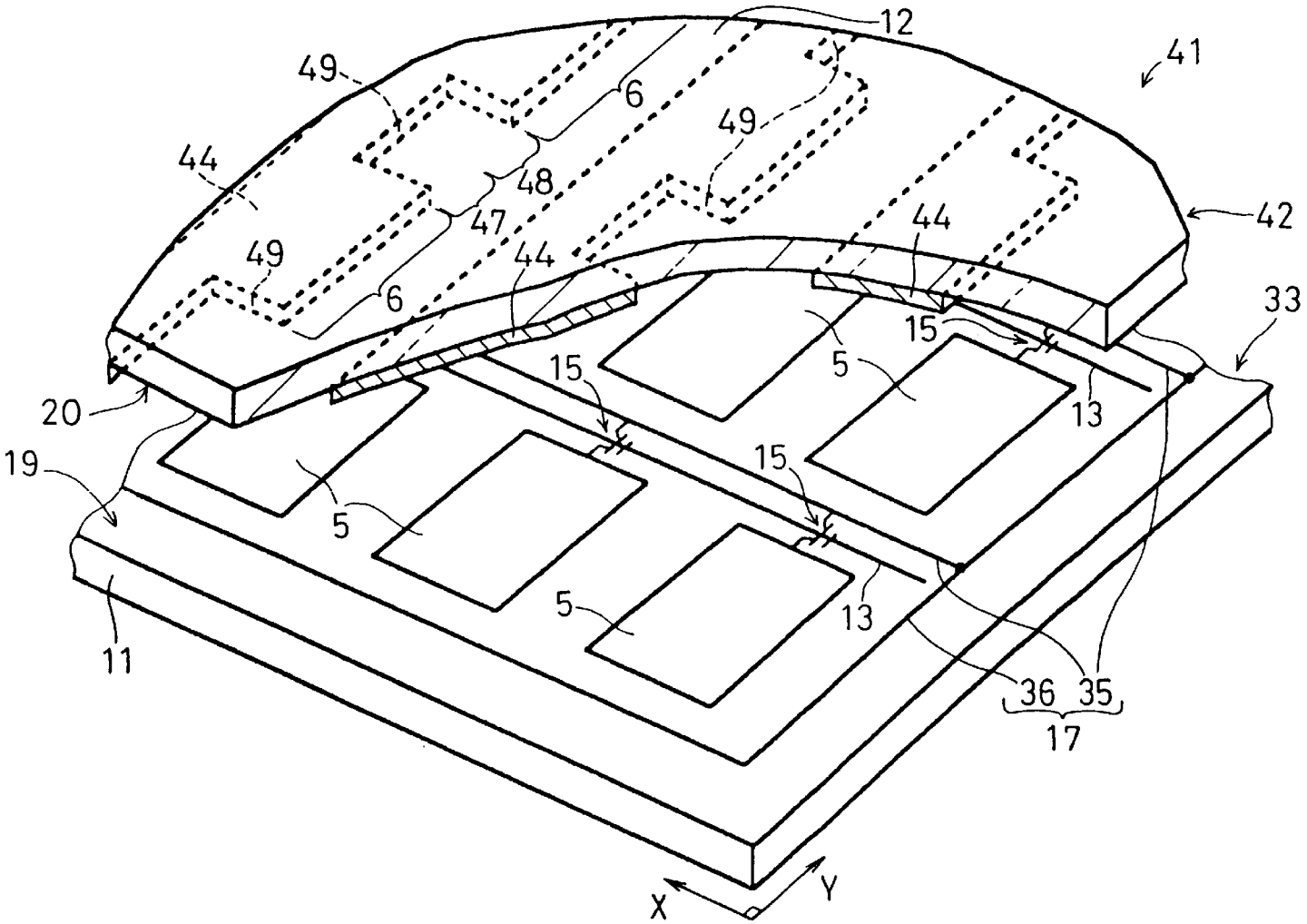
FIG. 14 is a partial enlarged perspective view schematically showing the configuration of a panel section 41 of a liquid crystal display device which is a fourth embodiment of the invention.
Figure 15:
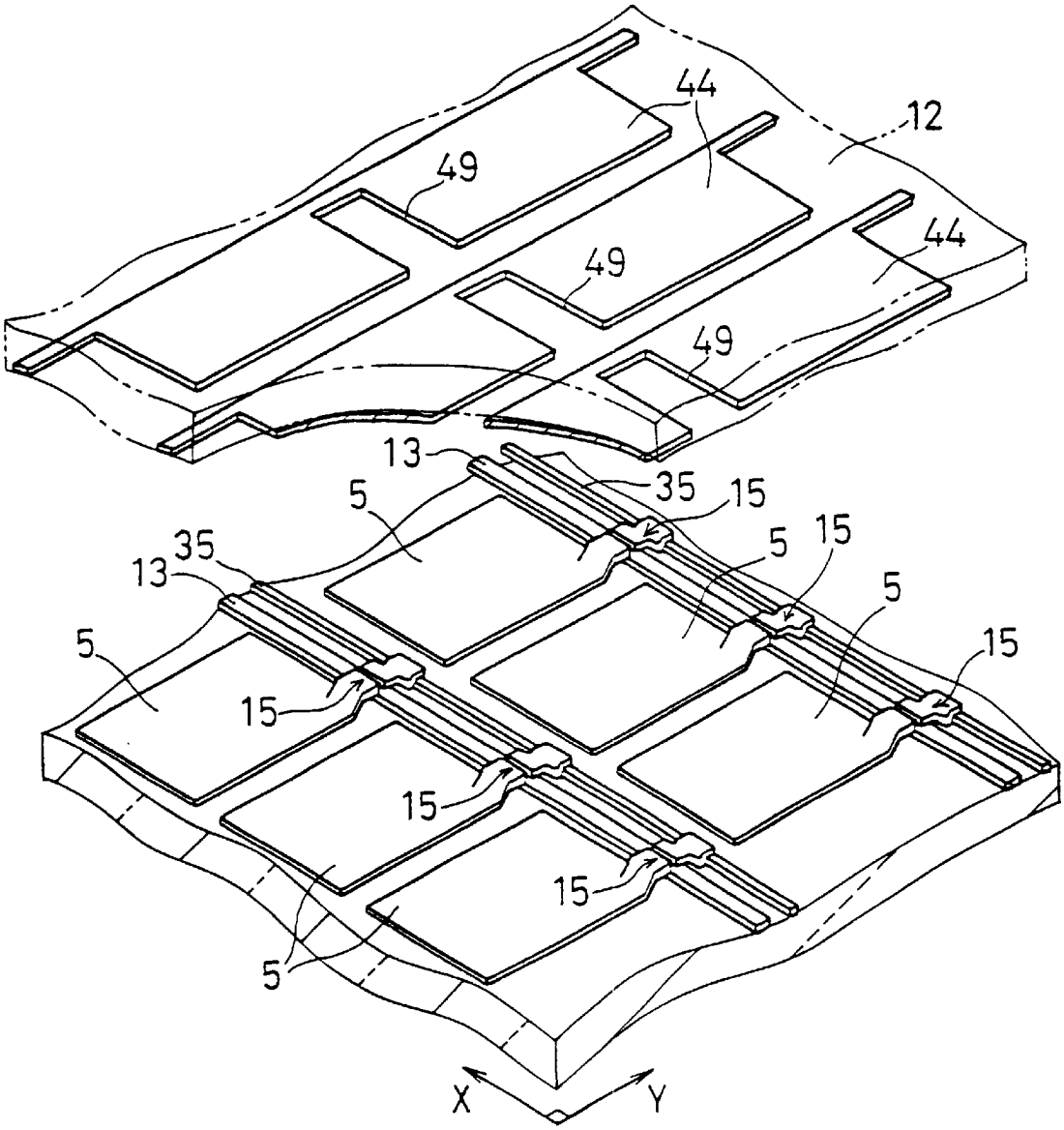
FIG. 15 is a partial enlarged perspective view specifically showing the configuration of the panel section 41 of the liquid crystal display device of the fourth embodiment.

FIG. 14 is a perspective view schematically showing the configuration of a panel section 41 of a liquid crystal display device which is a fourth embodiment of the invention, and FIG. 15 is a perspective view specifically showing the structure of the panel section 41 of FIG. 14. The embodiment will be described with reference to FIGS. 14 and 15. The liquid crystal display device of the fourth embodiment (hereinafter, often referred to as "fourth liquid crystal display device") is configured in the same manner as the liquid crystal display device of the second embodiment (hereinafter, often referred to as "second liquid crystal display device") except the points which will be described later. Among components of the fourth liquid crystal display device, those which are identical with those of the second liquid crystal display device are designated by the same reference numerals as those of the second liquid crystal display device, and their detailed description may be omitted.

The panel section 41 basically includes pixels 3. In the embodiment, the panel section includes a plurality of pixels 3. The panel section 41 of the embodiment is a panel section of the active matrix type in which three-terminal active elements are used as switching elements, and which has the counter source structure. In the embodiment, TFTs are used as the three-terminal active elements. Specifically speaking, the panel section 41 is divided into a main substrate section 33, an counter substrate section 42, and a liquid crystal section. The main substrate section 33 and the liquid crystal section are configured in the same manner as those of the second liquid crystal display device. In FIGS. 14 and 15, apart of the counter substrate section 42 is cut away, and the liquid crystal section and the orientation films of the substrate sections 33 and 42 are not shown.

The counter substrate section 42 basically includes: counter electrodes 6 of all the pixels 3; gradation signal lines 14; an counter substrate 12; and orientation films. In the embodiment, it is assumed that the panel section includes a plurality of gradation signal lines 14. All the counter electrodes 6 and all the gradation signal lines 14 are placed on one face 20 of the counter substrate 12 in the same manner as those of the second embodiment. The orientation film of the counter substrate section 42 is identical with that of the counter substrate section of the first embodiment. Each of the gradation signal lines 14, and the counter electrodes 6 connected to the gradation signal line 14 are integrated to one another so as to form column electrodes 44 which are equal in number to the gradation signal lines 14. All the column electrodes 44 are arranged in the same manner as the column electrodes 37 of the second embodiment. In each of the column electrodes 44, each of parts respectively opposed to the pixel electrodes 5 corresponds to the counter electrode 6 of a pixel including the corresponding pixel electrode 5. The part of the column electrode 44 is often referred to as "counter electrode 6." The column electrodes 44 are disposed in a relation of skew position with respect to the scanning signal lines 13 and the reference signal line 17, respectively.

Each of the column electrodes 44 is configured by a strip-like thin film piece of an electrically conductive material. In each of the column electrodes 44, at least one of a part 47 which is opposed to a part of the scanning signal line 13 via the liquid crystal section (hereinafter, often referred to as "scanning line opposed part"), and a part 48 which is opposed to a part of the reference signal line 17 via the liquid crystal section (hereinafter, often referred to as "reference line opposed part") has an average area per unit length which is smaller than an average area per unit length of the remaining part of the column electrode 44 other than the one part. The shape of the column electrodes 44 will be specifically described later.

In the case where the liquid crystal layer is formed by a nematic liquid crystal and the panel section 41 is of the TN type or STN type, the panel section 41 further includes two polarizing plates. The two polarizing plates are placed in the same manner as those of the first embodiment. In the case where the liquid crystal display device can display a color image, a color filter is disposed on the main substrate 11 or the counter substrate 12. The main substrate section 33 may further include addition capacitor portions 18 the number of which is equal to that of the pixels 3. The optical properties of the main substrate 11, the counter substrate 12, the pixel electrodes 5, the counter electrodes 6, three kinds of signal lines 13, 14, and 17, the TFTs 15, and the two orientation films are identical with those of the first embodiment. When the counter electrodes 6 and the gradation signal lines 14 are integrated to one another, the column electrodes 44 are optically transparent in both the cases where the panel section 41 is of the reflection type, and where the panel section is of the transmission type. In the case where the panel section 41 is of the transmission type or the reflection type, the light source and the reflector plate are placed in the same manner as those of the first embodiment. The panel section 41 of the counter source structure is configured as described above.

The configuration of the column electrodes 44 will be specifically described. As described above, in each of the column electrodes 44, the average area per unit length of at least one of the scanning line opposed part 47 and the reference line opposed part 48 is smaller than that of the remaining part of the column electrode 44 other than the one part, for example, that of the counter electrode 6 in the column electrode 44. Therefore, each of the column electrodes 44 has a shape which is obtained by removing, from the electrically conductive strip-like film piece having the same width as the counter electrode 6 in the column electrode, a part in at least one of a position in the film piece opposed to the scanning signal line 13, and a position in the film piece opposed to a part of the reference signal line 17. The part which is formed by partly cutting away the column electrode 44 is often referred to as the cutaway part 49. When the cutaway part 49 is formed in the column electrode 44, the area of the column electrode 44 is smaller than that of a column electrode in a panel section of the counter source structure of the prior art, i.e., a panel section in which a column electrode has a strip-like shape and the cutaway part 49 is not formed. As a result, in the panel section 41 of the embodiment, the leakage low-frequency electric field can be made weaker than that in a panel section of the counter source structure of the prior art.

Figure 16:
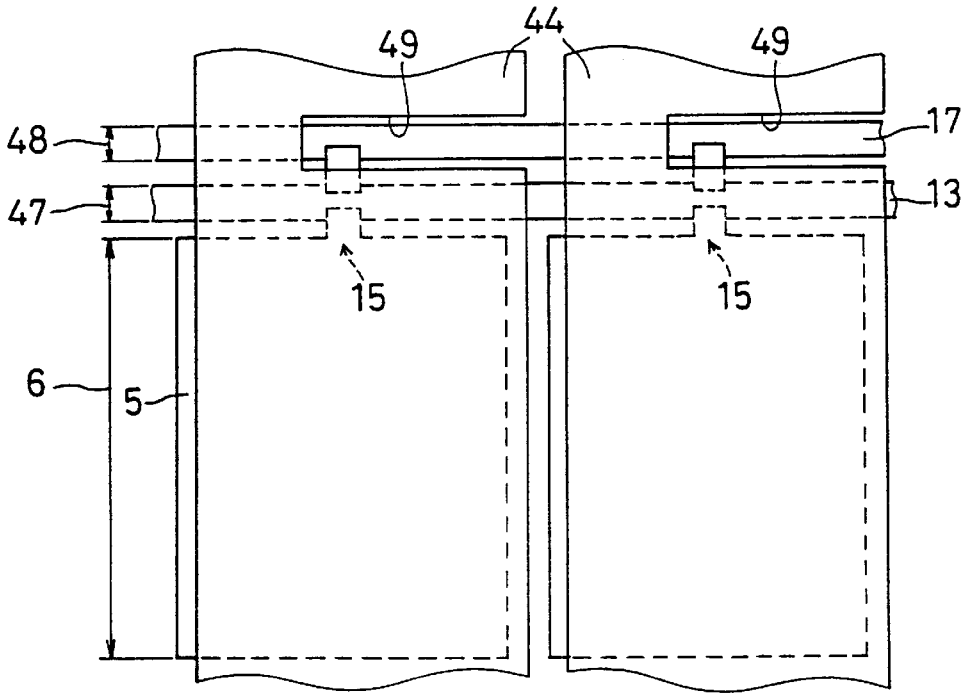
FIG. 16 is an partial enlarged plan view showing a first specific shape of column electrodes 44 of the panel section 41 in the fourth embodiment.
Figure 17:
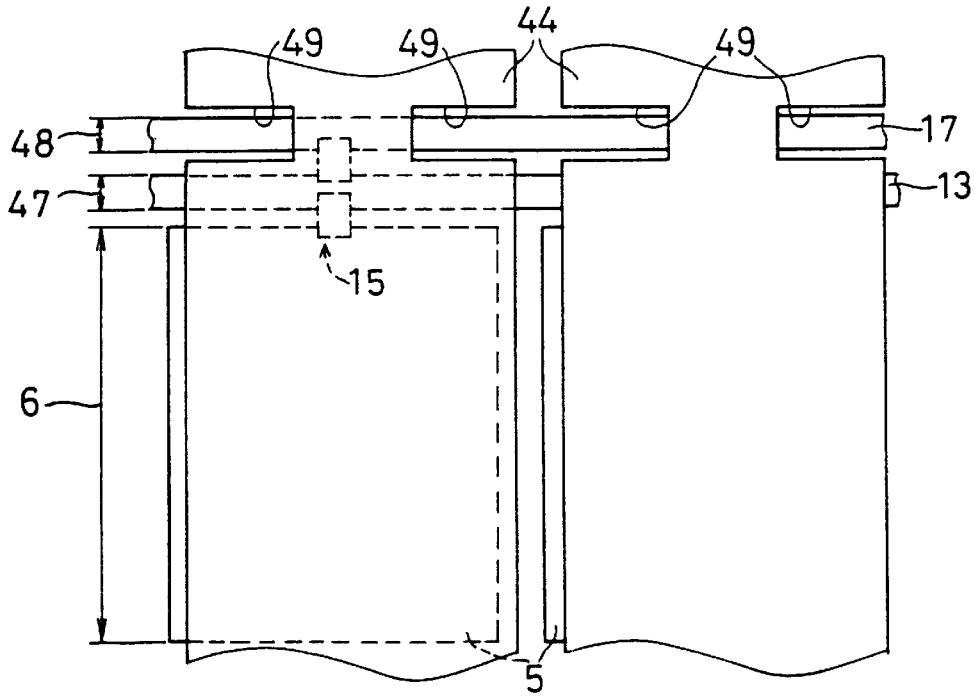
FIG. 17 is an partial enlarged plan view showing a second specific shape of the column electrodes 44 of the panel section 41 in the fourth embodiment.
Figure 18:
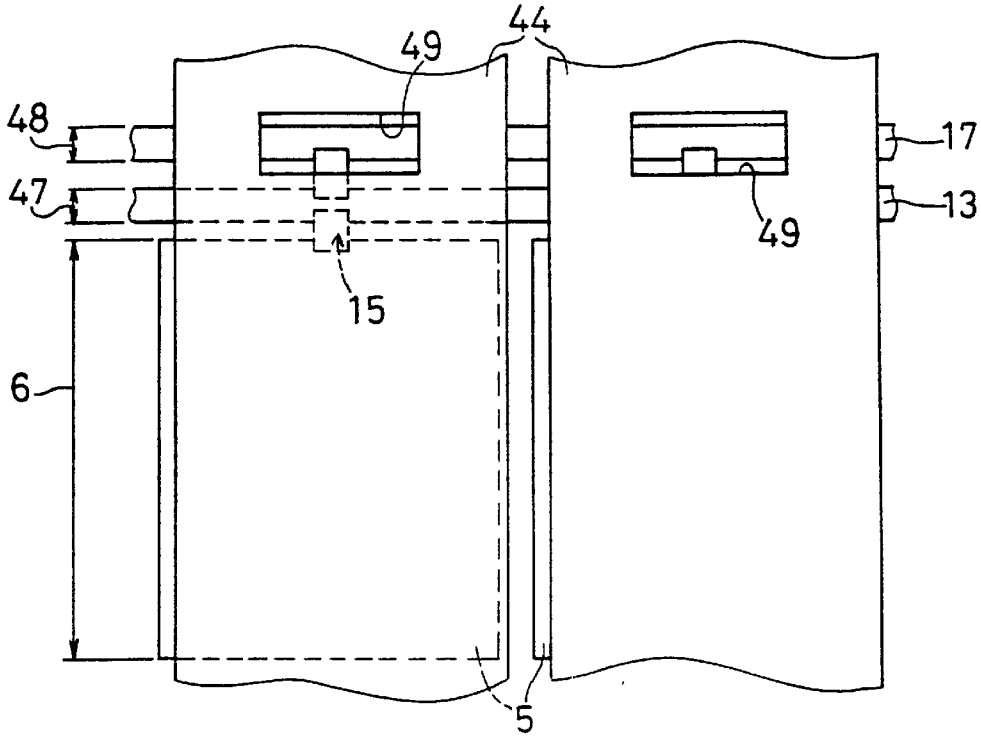
FIG. 18 is an partial enlarged plan view showing a third specific shape of the column electrodes 44 of the panel section 41 in the fourth embodiment.

In each of the column electrodes 44, preferably, the cutaway part 49 is formed at least in the reference line opposed part 48. FIGS. 16 to 18 are partial enlarged plan views of the panel section 41 and specifically illustrating the structure of the column electrodes 44, in the case where only the average area per unit length of the reference line opposed part 48 of each of the column electrodes 44 is smaller than that of the remaining part of the column electrode 44. In FIGS. 16 to 18, two adjacent pixels in the panel section 41 are enlargedly shown, and the liquid crystal section, the main substrate 11, the counter substrate 12, and the polarizing plates are not shown. In the above case, for example, the column electrodes 44 may have a structure in which, as shown in FIGS. 16 and 17, the width of the reference line opposed part 48 is reduced, or, as shown in FIG. 18, a hole is opened in the reference line opposed part 48. Specifically, the reduced width of the reference line opposed part 48 may be configured in the following manner. In the reference line opposed part 48, as shown in FIG. 16, one end part in the width direction of the column electrode may be cut away, or, as shown in FIG. 17, both the end parts in the width direction of the column electrode may be cut away.

In the case where the column electrodes 44 have either of the structures of FIGS. 16 to 18, an electric shielding member which is opposed to the reference signal line 17 in the panel section 41 of the embodiment is reduced as compared with that in a panel section of the counter source structure of the prior art. As a result, the effect of canceling a leakage low-frequency electric field caused by the reference signal supplied to the reference signal line 17 in the panel section 41 of the embodiment is greater than that of canceling a leakage low-frequency electric field caused by the reference signal in a panel section of the counter source structure of the prior art. Therefore, the leakage low-frequency electric field of the panel section 41 of the embodiment is further weaker than that of a liquid crystal display device including a panel section of the counter source structure of the prior art.

In the case where the column electrodes 44 have either of the structures of FIGS. 16 to 18, furthermore, the area of the reference line opposed part 48 of each of the column electrodes 44 in the panel section 41 of the embodiment is smaller than that that in a panel section of the counter source structure of the prior art. As a result, the cross capacitance of a reference line crossing part in the panel section 41 of the embodiment is smaller than that of the reference line crossing part in the panel section having the counter source structure of the prior art. The reference line crossing part is a part where the reference signal line 17 in the panel section is opposed to each of the column electrodes 44 via the liquid crystal section. The cross capacitance affects both the column electrodes 44 and the reference signal line 17, and causes the signals supplied to the column electrodes 44 and the reference signal line 17 to be delayed. In the panel section 41 of the embodiment, the cross capacitance is lowered, and hence the delay of the gradation signal and the reference signal can be reduced as compared with the panel section having the counter source structure of the prior art. Therefore, the display quality of the liquid crystal display device of the embodiment can be made higher than that of a liquid crystal display device including the panel section having the counter source structure of the prior art.

Figure 19:
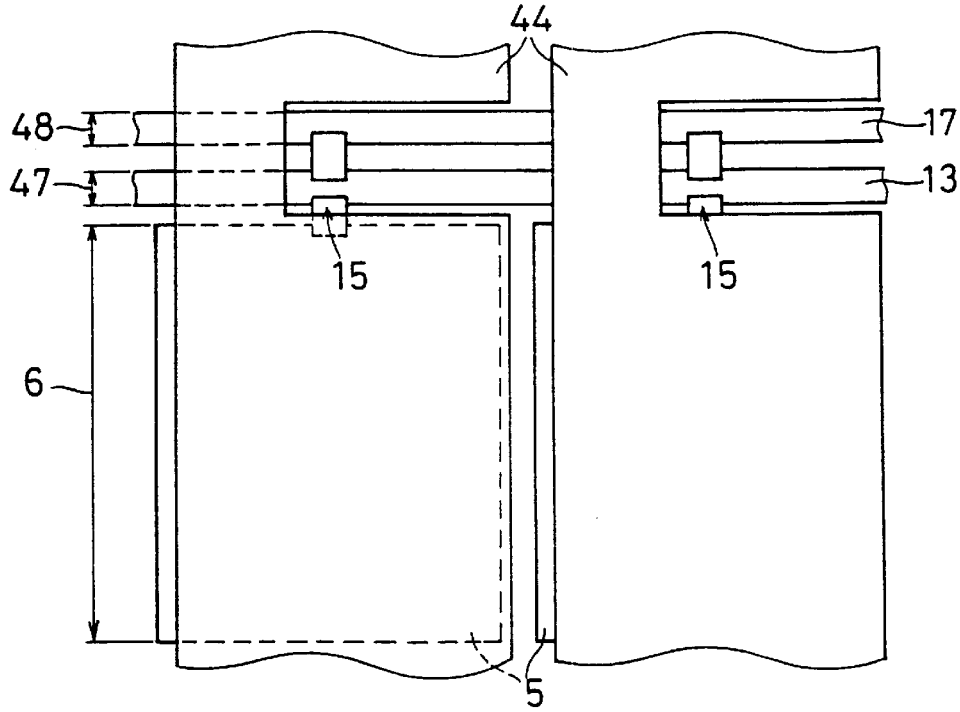
FIG. 19 is an partial enlarged plan view showing a fourth specific shape of the column electrodes 44 of the panel section 41 in the fourth embodiment.
Figure 20:
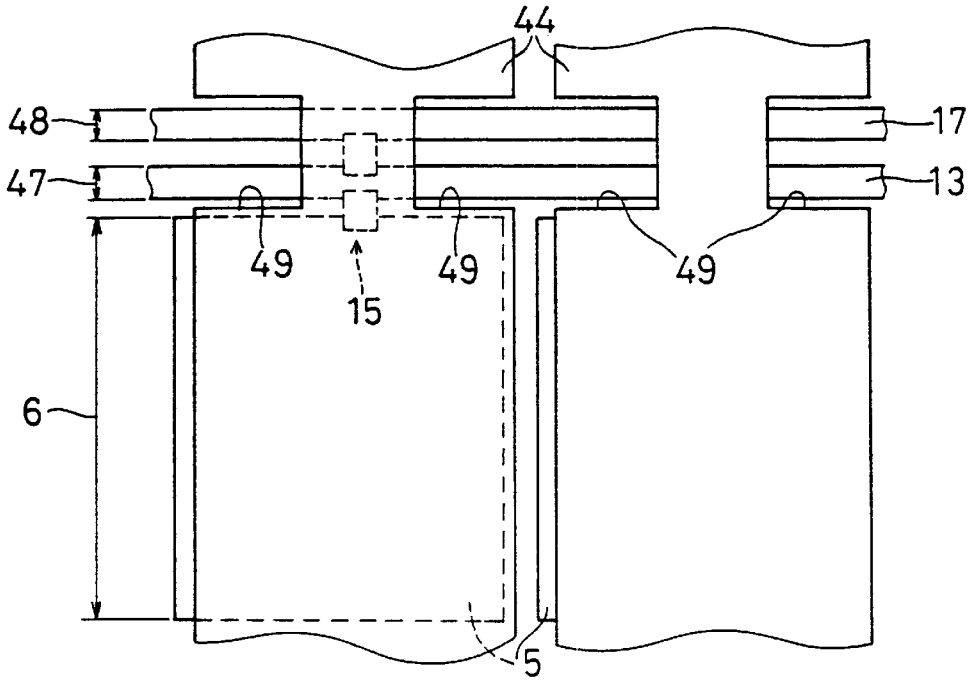
FIG. 20 is an partial enlarged plan view showing a fifth specific shape of the column electrodes 44 of the panel section 41 in the fourth embodiment.
Figure 21:
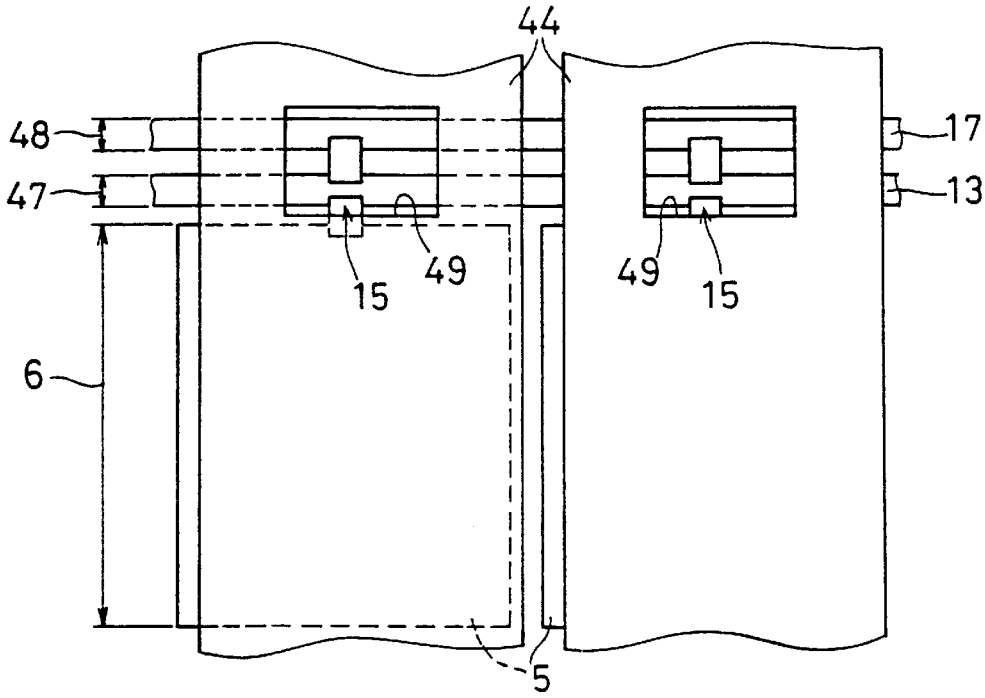
FIG. 21 is a partial enlarged plan view showing a sixth specific shape of the column electrodes 44 of the panel section 41 in the fourth embodiment.

FIGS. 19 to 21 are partial enlarged plan views of the panel section 41 and specifically illustrating the structure of the column electrodes 44, in the case where the average areas per unit length of the scanning line opposed part 47 and the reference line opposed part 48 of each of the column electrodes 44 are smaller than that of the remaining part of the column electrode 44. In FIGS. 19 to 21, two adjacent pixels in the panel section 41 are enlargedly shown, and the liquid crystal section, the main substrate, the counter substrate 38, and the polarizing plates are not shown. In the above case, for example, the column electrodes 44 may have a structure in which, as shown in FIGS. 19 and 20, the widths of the two opposed parts 47 and 48 are reduced, or, as shown in FIG. 21, a hole is opened in the two opposed parts 47 and 48. Specifically, the reduced widths of the two opposed parts 47 and 48 may be configured in the following manner. In the opposed parts 47 and 48, as shown in FIG. 19, one end part in the width direction of the column electrode may be cut away, or, as shown in FIG. 20, both the end parts in the width direction of the column electrode may be cut away.

In the case where the cutaway part 49 is formed in both the scanning line opposed part 47 and the reference line opposed part 48 as described above, the area of the column electrodes is smaller than the area of the column electrodes having the structures of FIGS. 16 to 18. As a result, in the case where the column electrodes 44 have either of the structures of FIGS. 19 and 21, the leakage low-frequency electric field of the panel section 41 of the embodiment can be further reduced. In the above case, not only the cross capacitance of the reference line crossing part in the panel section 41 of the embodiment, also the cross capacitance of the scanning line crossing part in the panel section 41 is smaller than that of the scanning line crossing part in the panel section having the counter source structure of the prior art. The scanning line crossing part is a part where the scanning signal line 13 in the panel section is opposed to each of the column electrodes 44 via the liquid crystal section. As a result, in the panel section 41 of the embodiment, not only the delay of the gradation signal and the reference signal, also the delay of the scanning signal can be reduced as compared with the panel section having the counter source structure of the prior art. In the above case, therefore, the display quality of the liquid crystal display device of the embodiment can be further improved.

In the case where the cutaway part 49 in at least one of the scanning line opposed part 47 and the reference line opposed part 48 is a hole as shown in FIGS. 18 and 21, the two counter electrodes 6 located on both sides of the one opposed part are connected to each other through a plurality of parts remaining in the column electrode 44. Even when one of the plurality of parts is broken, therefore, the two counter electrodes 6 are electrically connected to each other through remaining parts. Namely, in the above case, the column electrode 44 is hardly broken in the scanning line opposed part 47 and the reference line opposed part 48. This is preferable. In the case where a hole is formed as the cutaway part 49 as shown in FIGS. 18 and 21, and tow or more holes may be formed. Alternatively, as the cutaway part 49 in one opposed part, both a cutaway part of an end portion, and holes may be formed. The cutaway part 49 shown in each of FIGS. 16 to 21 has a rectangular shape. However, the shape of the cutaway part 49 is not restricted to a rectangle, and the cutaway part may have another shape such as a circle or an ellipse.

The structure of the column electrodes 44 is not restricted to the structures shown in FIGS. 16 to 21. The column electrodes may have another structure such as that in which the cutaway part 49 is formed only in the scanning line opposed part 47. In this case, at least the area of the column electrodes 44 is smaller than that of the column electrodes of the panel section having the counter source structure of the prior art, and hence the leakage low-frequency electric field of the panel section 41 of the embodiment is weaker than that of the panel section having the counter source structure of the prior art. In the examples of FIGS. 19 to 21, the cutaway part 49 of the column electrode 44 extends not only over the two opposed parts 47 and 48 and also over the portion between the opposed parts 47 and 48. Alternatively, the cutaway part 49 may be disposed in each of the two opposed parts 47 and 48. In the case where the cutaway part 49 of the column electrode 44 has either of the structures of FIGS. 19 to 21, the area of the column electrodes 44 is smaller than that in the case where the cutaway part 49 is disposed in each of the two opposed parts 47 and 48. Therefore, the former case is more preferable than the latter case because the leakage low-frequency electric field is weaker. The column electrodes 44 are structured as described above.

The fourth liquid crystal display device further includes, in addition to the panel section 41, a driver for driving the panel section. The driver operates in the same manner as that of the second liquid crystal display device. The maximum voltage difference Vspp of the gradation signal supplied to the panel section 41 may be set to be equal to the voltage difference of the gradation signal in a liquid crystal display device having the counter source structure of the prior art, or may have a value within the allowable range defined by expressions 9 to 12. In the case where the maximum voltage difference Vspp of the gradation signal has a value within the allowable range, it is possible to achieve the effects which have been described in the second embodiment, in addition to the above-mentioned effects due to the shape of the column electrodes 44, and hence the leakage low-frequency electric field can be reduced more effectively, and the display quality of the fourth liquid crystal display device can be further improved. The dynamic range Vdyn of the liquid crystal of the panel section 41 may be equal to the dynamic range in a liquid crystal display device having the counter source structure of the prior art, or may have a value within the allowable range defined by expressions 24 to 27. In the case where the dynamic range Vdyn has a value within the allowable range, it is possible to achieve the effects which have been described in the third embodiment, in addition to the above-mentioned effects due to the shape of the column electrodes 44, and hence the leakage low-frequency electric field can be reduced more effectively, and the display quality of the fourth liquid crystal display device can be further improved.

The liquid crystal display devices of the first to fourth embodiments are examples of the display device of the invention. The display device can be implemented in other various manners while configuring main components in the same manner. For example, the components in the panel section, such as their shape and arrangement may be realized by a configuration other than the above-described configuration as far as the components have the same features. For example, the liquid crystal layer of each pixel 3 in the liquid crystal display device may be replaced with a display medium in which the state relating to a display is changed in accordance with the voltage between the two electrodes 5 and 6 in the pixel 3, such as an EL light emitting layer. In an EL light emitting layer, the amount of light due to EL luminescence is changed in accordance with the voltage. As a result, in the display device of the invention which uses the display medium and is driven by the line inversion driving, the leakage low-frequency electric field can be reduced as compared with a display device of the prior art. In place of the three-terminal active elements which are realized by, for example, TFTS, two-terminal active elements such as MIM elements may be used.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A display device comprising:

a panel section including a plurality of pixel electrodes which are arranged in a predetermined reference plane, a display medium layer consisting of a display medium whose state relating to a display is changed in accordance with an electric field, and a single common electrode which is opposed to all the pixel electrodes via the display medium layer;

gradation signal supplying means for supplying a gradation signal of a voltage which varies with time, to the respective pixel electrodes, in order to define the electric field for controlling the state of the display medium interposed between the pixel electrodes and the counter electrodes; and reference signal supplying means for supplying a reference signal of a voltage which varies in a predetermined pattern with time, to the common electrode, a difference Vbpp between maximum and minimum voltages of the reference signal, being equal to or smaller than a first upper limit voltage difference VMAX1 which is defined by an area x [$m^2$] of the common electrode as follows:

$$VMAX1=0.3578\times x^{-0.6156}\ [V].$$

2. The display device of claim 1, wherein the panel section further includes:

a plurality of gradation signal lines interposed between the gradation signal supplying means and the pixel electrodes;

a plurality of switching elements interposed between the gradation signal lines and the pixel electrodes, respectively; and a plurality of scanning signal lines for supplying an opening/closing signal to the switching elements to control an opening/closing state of each of the switching elements.

3. The display device of claim 1, wherein the display medium is a liquid crystal.

4. A display device comprising:

a panel section including a plurality of pixel electrodes which are arranged in a predetermined reference plane; a display medium layer consisting of a display medium whose state relating to a display is changed in accordance with an electric field; and a plurality of counter electrodes which are opposed to the pixel electrodes via the display medium layer, respectively;

reference signal supplying means for supplying a reference signal of a voltage which varies in a predetermined pattern with time, to all of the pixel electrodes; and gradation signal supplying means for supplying a gradation signal of a voltage variable with time, to the respective counter electrodes in order to define the electric field for controlling the state of the display medium interposed between the pixel electrodes and the counter electrodes, a difference Vspp between maximum and minimum voltages of the gradation signal, which is equal to or smaller than a second upper limit voltage difference VMAX2 which is defined by an area x [$m^2$] of a predetermined display region where all the pixel electrodes can be arranged, and a ratio y of an area of all the counter electrodes to the area x of the display region as follows:

$$VMAX2=a\times x^{-b} \quad [V]$$

wherein $a=0.3565\times y^{-0.6829}$ $b=-0.0937y+0.7091.$

5. The display device of claim 4, wherein the panel section further includes a plurality of gradation signal lines which are interposed between the gradation signal supplying means and the counter electrodes, and a plurality of reference signal lines which are interposed between the reference signal supplying means and the pixel electrodes, and the gradation signal lines are disposed in a relation of skew position with respect to the reference signal lines, respectively.

6. The display device of claim 5, wherein the gradation signal lines and the counter electrodes connected thereto are integrated to form an electrically conductive portion, and an area per unit length of a first part of the electrically conductive portion is smaller than an area per unit length of a remaining part of the electrically conductive portion other than the first part, the first part being opposed to the reference signal lines.

7. The display device of claim 6, wherein the electrically conductive portion has a substantially strip-like shape, and a hole is opened in the first part in the electrically conductive portion.

8. The display device of claim 5, wherein the panel section further includes a plurality of switching elements which are interposed between the reference signal lines and the pixel electrodes, respectively, and a plurality of scanning signal lines for supplying an opening/closing signal to the switching elements to control an opening/closing state of each of the switching elements, and the scanning signal lines are disposed in a relation of skew position with respect to the gradation signal lines, respectively.

9. The display device of claim 8, wherein the gradation signal lines and the counter electrodes connected thereto are integrated to form an electrically conductive portion, and an area per unit length of a second part of the electrically conductive portion is smaller than an area per unit length of a remaining part of the electrically conductive portion other than the second part, the second part being opposed to the scanning signal lines.

10. The display device of claim 9, wherein the electrically conductive portion has a substantially strip-like shape, and a hole is opened in the second part in the electrically conductive portion.

11. The display device of claim 4, wherein the display medium is a liquid crystal.

12. A display device comprising:

a panel section including a plurality of pixel electrodes which are arranged in a predetermined reference plane, a display medium layer consisting of a display medium whose state relating to a display is changed in accordance with an electric field, and a plurality of counter electrodes which are opposed to the pixel electrodes via the display medium layer, respectively;

reference signal supplying means for supplying a reference signal of a voltage which varies in a predetermined pattern with time, to all the pixel electrodes; and gradation signal supplying means for supplying a gradation signal of a voltage variable with time, to each of the counter electrodes in order to define the electric field for controlling the state of the display medium interposed between the pixel electrodes and the counter electrodes, a difference Vdyn between a voltage between the pixel electrodes and the counter electrodes in the case where an electric field for setting the state of the display medium to a predetermined first state is defined, and a voltage between the pixel electrodes and the counter electrodes in the case where an electric field for setting the state of the display medium to a second state which is different from the first state is defined, being equal to or smaller than a third upper limit voltage difference VMAX3 which is defined by an area x [$m^2$] of a predetermined display region where all the pixel electrodes can be arranged, and a ratio y of an area of all the counter electrode to the area x of the display region as follows:

$$VMAX3=a\times x^{-b} \quad [V]$$

wherein $a=0.3565\times y^{-0.6829}$ $b=-0.0937y+0.7091.$

13. The display device of claim 12, wherein the panel section further includes a plurality of gradation signal lines which are interposed between the gradation signal supplying means and the counter electrodes, and a plurality of reference signal lines which are interposed between the reference signal supplying means and the pixel electrodes, and the gradation signal lines are disposed in a relation of skew position with respect to the reference signal lines, respectively.

14. The display device of claim 13, wherein the gradation signal lines and the counter electrodes connected thereto are integrated to form an electrically conductive portion, and an area per unit length of a first part of the electrically conductive portion is smaller than an area per unit length of a remaining part of the electrically conductive portion other than the first part, the first part being opposed to the reference signal lines.

15. The display device of claim 14, wherein the electrically conductive portion has a substantially strip-like shape, and a hole is opened in the first part in the electrically conductive portion.

16. The display device of claim 13, wherein the panel section further includes a plurality of switching elements which are interposed between the reference signal lines and the pixel electrodes, respectively, and a plurality of scanning signal lines for supplying an opening/closing signal to the switching elements to control an opening/closing state of each of the switching elements, and the scanning signal lines are disposed in a relation of skew position with respect to the gradation signal lines, respectively.

17. The display device of claim 16, wherein the gradation signal lines and the counter electrodes connected thereto are integrated to form an electrically conductive portion, and an area per unit length of a second part of the electrically conductive portion is smaller than an area per unit length of a remaining part of the electrically conductive portion other than the second part, the second part being opposed to the scanning signal lines.

18. The display device of claim 17, wherein the electrically conductive portion has a substantially strip-like shape, and a hole is opened in the second part in the electrically conductive portion.

19. The display device of claim 12, wherein the display medium is a liquid crystal.

* * * * *